US007156898B2

(12) United States Patent
Jaisinghani

(10) Patent No.: US 7,156,898 B2
(45) Date of Patent: Jan. 2, 2007

(54) LOW PRESSURE DROP DEEP ELECTRICALLY ENHANCED FILTER

(76) Inventor: Rajan A. Jaisinghani, 13511 E. Boundary Rd., Suite D/E, Midlothian, VA (US) 23112-3941

( * ) Notice: Subject to any disclaimer, the term of this patent is extended or adjusted under 35 U.S.C. 154(b) by 75 days.

(21) Appl. No.: 10/618,457

(22) Filed: Jul. 14, 2003

(65) Prior Publication Data

US 2004/0074387 A1 Apr. 22, 2004

Related U.S. Application Data

(60) Provisional application No. 60/465,277, filed on Apr. 25, 2003, provisional application No. 60/437,140, filed on Feb. 10, 2003, provisional application No. 60/395,322, filed on Jul. 12, 2002.

(51) Int. Cl.
*B03C 3/155* (2006.01)

(52) U.S. Cl. ..... 95/63; 55/497; 55/521; 55/DIG. 5; 95/78; 95/79; 96/59; 96/62; 96/67; 96/96; 264/257; 264/DIG. 48

(58) Field of Classification Search ..... 96/15, 96/17, 62, 55–59, 99, 65–69, 96; 95/63, 95/69, 70, 79, 78; 55/521, 497, DIG. 5; 264/257, 258, DIG. 48
See application file for complete search history.

(56) References Cited

U.S. PATENT DOCUMENTS 2,352,651 A 7/1944 Meston ..... 140/71.5
2,789,657 A 4/1957 Fields ..... 96/79
2,798,572 A 7/1957 Fields ..... 96/79

(Continued)

FOREIGN PATENT DOCUMENTS

JP 61-209061 * 9/1986 ..... 96/67

OTHER PUBLICATIONS

Jaisinghani, et al., "Advantages of Electrically Stimulated Air Filtration Over Conventional Filtration", *Fluid Particle Separation Journal*, vol. 1, No. 2, Dec. 1998 pp. 99-102.

(Continued)

*Primary Examiner*—Richard L. Chiesa
(74) *Attorney, Agent, or Firm*—Robert E. Bushnell, Esq.

(57) ABSTRACT

A method and apparatus using deep pleated filters to provide efficient and safe electrically enhanced filtering (EEF), with ultra low pressure drop, higher efficiency of particulate removal and higher dirt holding capacity over the life of the filter. An EEF may be constructed with a housing, with or without an internal air moving device such as a fan, a deeply pleated filter, preferably a V-pack filter with sets of downstream ground electrodes and charge transfer electrodes borne by the exterior surface of the filter packs that form the filtering element. An ionizer assembly that ionizes the gas and charges particles entering the deeply pleated filter and also transfers a charge to the charge transfer electrodes on the filter pack. A plate seals the gasket on the filtering element against the ionizing assembly. A high electrical potential is applied to charging elements in the ionizer and, in some embodiments, a fan or motor assembly. The charge transfer electrodes enable the device to function with a high particle collection field between the charge transfer electrodes and the downstream grounded electrodes to safely and efficiently attain higher entrapment of the particles on the filter medium.

126 Claims, 23 Drawing Sheets

U.S. PATENT DOCUMENTS

| | | | | | |
|---|---|---|---|---|---|
| 2,864,460 | A | * | 12/1958 | Powers | 96/67 |
| 2,888,092 | A | * | 5/1959 | Powers | 96/67 |
| 2,908,348 | A | * | 10/1959 | Rivers et al. | 96/67 |
| 3,181,284 | A | * | 5/1965 | Copenhefer | 96/67 |
| 3,910,779 | A | | 10/1975 | Penney | 95/66 |
| 3,979,189 | A | | 9/1976 | Alskog | 96/58 |
| 3,999,964 | A | * | 12/1976 | Carr | 96/59 |
| 4,018,577 | A | | 4/1977 | Shibuya et al. | 96/78 |
| 4,266,948 | A | | 5/1981 | Teague et al. | 96/57 |
| 4,317,661 | A | | 3/1982 | Sasaoka et al. | 96/67 |
| 4,357,150 | A | | 11/1982 | Masuda et al. | 95/63 |
| 4,509,958 | A | | 4/1985 | Masuda et al. | 96/60 |
| 4,715,870 | A | | 12/1987 | Masuda et al. | 96/67 |
| 4,750,921 | A | | 6/1988 | Sugita et al. | 96/67 |
| 4,781,736 | A | | 11/1988 | Cheney et al. | 96/60 |
| 4,853,005 | A | | 8/1989 | Jaisinghani et al. | 96/60 |
| 4,886,526 | A | * | 12/1989 | Joannou | 96/67 |
| 4,940,470 | A | | 7/1990 | Jaisinghani et al. | 95/78 |
| 5,108,470 | A | * | 4/1992 | Pick | 96/58 |
| 5,185,015 | A | | 2/1993 | Searle | 96/16 |
| 5,330,559 | A | * | 7/1994 | Cheney et al. | 96/53 |
| 5,403,383 | A | | 4/1995 | Jaisinghani | 95/69 |
| 5,474,599 | A | * | 12/1995 | Cheney et al. | 96/55 |
| 5,573,577 | A | * | 11/1996 | Joannou | 96/66 |
| 5,593,476 | A | * | 1/1997 | Coppom | 95/78 |
| 5,855,653 | A | * | 1/1999 | Yamamoto | 96/58 |
| 6,251,171 | B1 | * | 6/2001 | Marra et al. | 96/69 |
| 6,294,004 | B1 | * | 9/2001 | Summers et al. | 96/66 |
| 6,491,743 | B1 | * | 12/2002 | Joannou et al. | 96/67 |
| 6,497,754 | B1 | * | 12/2002 | Joannou | 96/67 |
| 6,514,324 | B1 | * | 2/2003 | Chapman | 96/67 |
| 6,709,480 | B1 | * | 3/2004 | Sundet et al. | 55/499 |
| 2002/0170435 | A1 | * | 11/2002 | Joannou | 96/66 |

OTHER PUBLICATIONS

Jaisinghani, et al., "Effect of Relative Humidity on Electrically Stimulated Filter Performance", *APCA Journal*, vol. 37, Jul. 1987, pp. 823-828.

Jasinghani, et al., "Performance Characteristics of a Two Electrode Ionizing Electrically Stimulated Filter", Annual Meeting of the Fine Particle Society, Jul. 1988, Santa Clara, California.

Rajan Jaisinghani, "*Go With The Flow: A Discussion of Energy Efficient Airflow Design for Cleanrooms" The European Journal of Contamination Control Cleanroom Technology Magazine*, Jan. 2002.

Rajan Jaisinghani, "*High Filtration/Biocidal Performance Cleanroom System" Presented at Cleanrooms 96' West The Conference on Advanced Microcontamination Control. and Ultrapure Manufacturing, Santa Clara Convention Center*, Santa Clara, California, Oct. 28-30, 1996.

Rajan Jaisinghani, "*Air Handling Considerations for Efficient Cleanroom Design" For Cleanrooms*, Jan. 2001 *issue*.

Rajan Jaisinghani, "*Air Handling Considerations for Cleanrooms", Presented at the 2001 InterPhex Conference*, Philadelphia, Pennsylvania, Mar. 20-22, 2001.

Rajan Jaisinghani, "*New Bactericidal Electrically Enhanced Filtration Systems For Cleanrooms", Presented at the IEST's 44th Annual Technical meeting and exposition in* Phoenix, Arizona, Apr. 26-May 1, 1998.

Rajan Jaisinghani, "*Air Handling Considerations for Cleanroom Design", Presented at Cleanrooms East 2002*, Boston, Massachusetts, Mar. 12-14, 2001.

Rajan Jaisinghani, "*Energy Efficient Cleanroom Design Power Point Presentation", For Technocation Systems, Inc.*, Jul. 2001.

* cited by examiner

LOW PRESSURE DROP DEEP ELECTRICALLY ENHANCED FILTER

CLAIM FOR PRIORITY

This application makes reference to, claims all benefits inuring under 35 U.S.C. §111(b) from, and incorporates herein my provisional patent application entitled Low Pressure Drop Deep Electrically Enhanced Filter earlier filed in the United States Patent and Trademark Office on the 12$^{th}$ day of Jul. 2002 and there duly assigned Ser. No. 60/395,322, my provisional patent application entitled Low Pressure Drop Deep Electrically Enhanced Filter earlier filed in the United States Patent and Trademark Office on the 10$^{th}$ day of Feb. 2003 and there duly assigned Ser. No. 60/437,140, and my provisional patent application entitled Low Pressure Drop Deep Electrically Enhanced Filter earlier filed in the United States Patent and Trademark Office on the 25$^{th}$ day of Apr. 2003 and there duly assigned Ser. No. 60/465,277.

BACKGROUND OF THE INVENTION

1. Technical Field

This application pertains to filters and filtration processes and systems generally and, more particularly, to the enablement of the use of deep filter media used in ionizing electrically enhanced filtration processes and filters while functioning as high performance devices with ultra-low pressure drop, to filtration systems and to processes or constructing filters and filtration systems.

2. Related Art

Jaisinghani, A Safe Ionizing Field Electronically Enhanced Filter and Process For Safely Ionizing A Field Of An Electrically Enhanced Filter U.S. Pat. No. 5,403,383, describes an ionizing electrically enhanced filter that has sufficiently high performance to have become the only successfully commercialized Electrically Enhanced Filter (i.e., EEF). It has found uses in cleanrooms and in other critical applications, and also in residential and commercial building applications requiring clean indoor air. Recently, *Consumer Reports* (February 2003) rated a device based on the teachings of this patent as being the highest performance residential air cleaner.

The main advantages of electrically enhanced filtration technology are high filtration efficiency with low-pressure drop, higher filter dust holding capacity of life, and low resistance to air flow, the safety of these devices constructed with electrically enhanced technology and the ability of these devices to function without problems for the duration of the life of the product; these filters also have some bactericidal properties.

In contrast, non-EEF type conventional mechanical filters exhibit a higher pressure drop. Embodiments constructed according to the principles of U.S. Pat. No. 5,403,383 are limited as a practical matter, to relatively shallow filter media with peak-to-peak depths of about six inches.

Recent advances in filter construction have resulted in the availability of very low-pressure drop mechanical filters. For example, a class of filters known as mini-pleated V-pack filters have lower pressure drop than older deep filters such as aluminum separator type folded media and other conventional filters. A typical V-pack filter is about twelve inches deep and has a filter efficiency of 99.99% with a particle size of 0.3 micrometers, and has a pressure drop of about one inch water column at a filter face flow velocity of 600 feet per minute. Another grade of such a V-pack filter has a filtration efficiency of 95% at 0.3 micrometers particle size, and has a pressure drop of about one-half of an inch water column (i.e., 0.5" WC) at a filter face air flow velocity of 600 feet per minute. I have found that if such a 95% filter could be enhanced in a safe electrical manner to provide approximately 99.97 to 99.99% filtration efficiency at 0.3 micrometer particle size (commonly referred to as HEPA filtration efficiency), then an ultra low pressure drop HEPA filter could be achieved with significant savings in operational costs than are available with conventional HEPA filters. Similarly lower grade, deep V-pack or other forms of deep filter material could be safely electrically enhanced to produce higher efficiency filters having significantly lower pressure drops. The operating cost savings would be in terms of fan power required and the longevity of the filter, improvements that result in savings in terms of energy, downtime, labor and material costs related to filter replacement and maintenance. The consequential benefits in industrial applications (cf. Jaisinghani, "Energy Efficient Cleanroom Design", 2000) could be as high as 60% savings in energy consumption related to air moving.

Cheney and Spurgin in their Electrostatically Enhanced HEPA Filter, U.S. Pat. No. 4,781,736 describe an EEF that can be used with deeply folded filter media that has corrugated aluminum separators positioned within the folds. Cheney '736 is limited to using such separators as electrodes within folded dielectric filter media in paper form. The essential objective of Cheney '736 is an attempt to provide electrostatic augmented filtration that allows retrofitting or direct use of existing filters (referring to aluminum corrugated separator deep filters). Cheney '736 requires corrugated separators used as electrodes placed within folded media; if the electrodes in Cheney '736 were flat, those electrodes could not function as separators.

I have noticed that filters such as those taught by Cheney '736 rely upon sets of spacers to separate the filter media in an effort to reduce pressure drop and resistance to the air flow. I have found that this undesirably reduces the surface area of filter media available to remove particles from the air flow, principally due to the fact that these spacers have a minimum depth to the corrugations which restricts the number of pleats that can be used within an available volume. By contrast, mini pleat technology that uses glue beads or ribbons to separate the pleats enables approximately twice as much filter media when used in a V-pack configuration. Another problem that I have discovered, related to the use of aluminum separators, is that under fluctuating flow or start up flow conditions these sharp corrugated separators can cut the delicate fiber glass media used in such filters, causing damage and leakage within the filter media.

Embodiments of the Cheney and Spurgin disclosed in their U.S. Pat. No. 4,781,736 reference are also restricted to the use of an ionizer that uses parallel plates because the flow is parallel to the air flow direction. I have noticed that there are problems with parallel ionizer plates attributable to dust particles of opposing charge that tend to accumulate on the ionizer plates because the dust particles have to travel only across the direction of the air flow in order to accumulate on the plates. As highly resistive dust builds up an accumulation on the plates, an opposing field can be created, thereby canceling the applied field strength that ionizes the air. I have observed that this phenomenon can sometimes generate undesired back corona discharge.

Cheney '736 also sought a significant reduction in the capacitance of the device in comparison to the teachings of Masuda found in U.S. Pat. Nos. 4,357,150 and 4,509,958, in order to minimize the energy available for arcing. Although it is unclear whether this method may reduce the energy available for arcing as compared to Masuda '150 and '958, it reduces neither arcing and the consequent damage to the media nor the potential for fire, because pin holes can be created on the delicate glass media even with low energy arcing. Embodiments of Masuda are highly prone to arcing.

I have also found that a device constructed in accordance with Cheney '763 lacks a uniform electrical field, exhibits a low collector field strength, demonstrates a high potential for sparking, tends to have excessive leakage current, and requires construction of its frame from non-conductive materials, as is explained in the following discussion.

In order to prevent sparking towards the frame material, the frame material in the practice of Cheney '736 must be a non-conductive material, typically wood, because the aluminum spacers of the upstream corrugated electrodes will probably contact the frame material at some location. Contemporary manufacturing methods have switched to the use of aluminum or metal channel frames that do not shed particles, provide better seals to the media and are not flammable. The use of organic materials for the frames as suggested by Cheney '736 is rather dirty, and thus undesirable for clean room applications.

It should be noted that Cheney '736 does not describe any values for electrode gaps or ranges of voltages used in any of the configurations illustrated, nor does Cheney '736 provide any results showing the efficacy of the embodiments disclosed. These practical difficulties and limitations upon performance are the main reason why a device such as taught by Cheney '736 has never been successfully commercialized. Additionally, aluminum separator folded filter type filter elements have become unpopular because this type of filter element tends to tear due to the sharp edges of the aluminum separators within the folded medium.

SUMMARY OF THE INVENTION

It is therefore, an object of the present invention to provide an improved electrically enhanced filtration process and filter, and process for manufacturing electrically enhanced filters and filtration systems and the individual components of these filters and filtration systems.

It is another object to provide electrically enhanced filtration with a deep filter exhibiting high surface area in a manner that enables the creation of stable and uniform collection field strengths while suppressing arcing across the filter media.

It is yet another object to provide electrically enhanced filtration with a deep filter that exhibits a high surface area in a manner that enables the creation of stable and uniform collection field strengths in a safe manner.

It is still another object to enable electrically enhanced filtration with a deep filter that provides a high surface area in a manner that allows the creation of stable and uniform collection field strengths by using an ionizer that is not prone to back corona discharge or ionizing field cancellation effects attributable to the collection of highly resistive dust on the ground electrode plate of the ionizer.

It is still yet another object to enable electrically enhanced filtration with a deep filter that provides a high surface area and allows the creation of stable and uniform collection field strength in a manner that it is at least as effective as the filtration achieved by contemporary devices.

It is a further object to enable high efficiency filtration with very low pressure drops and low resistance to air flow, by electrically enhancing the performance of deep V-pack filter elements.

It is a yet further object to provide a high efficiency particulate air (i.e., a HEPA filter) with about half the pressure drop of the best currently available deep V-pack HEPA filter elements.

It is a still further object to provide a filter that inhibits the growth of microorganisms caught on the filter and that has the potential to actually kill some bacteria entering the filter.

It is also an object to provide a process for constructing a deep V-pack filter element that can be used as an effective and safe electrically enhanced filter.

It is an additional object to enable high efficiency filtration with higher dust holding capacity and thus life of the filter, by electrically enhancing the performance of deep V-pack filter elements.

These and other objects may be achieved with a deep V-pack filter element bearing a charge transfer electrode (i.e., a CTE electrode) formed on the obverse side of the filter media and a ground potential electrode formed on the reverse side of the filter media. The filter element may be disposed within the flow of a stream of transient air directed toward the obverse side of the filter medium bearing the charge transfer electrode oriented toward the upstream side of an electrostatically stimulating filtering apparatus, while an ionizer with a single ionizing electrode, or in alternative embodiments, a plurality of ionizing electrodes positioned in an array, is spaced-apart from opposite facing charge transfer electrodes. The ionizing electrode is located between the control ground electrode and the charge transfer electrode. A control electrode maintained at a local reference potential, is spaced apart and upstream from the ionizing electrode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 19 is an isometric view illustrating an arrangement of a typical housing for an embodiment of the present invention while FIG. 19A is a side view of an alternative embodiment of a grounding clip.

DETAILED DESCRIPTION OF THE INVENTION

Figure 12:
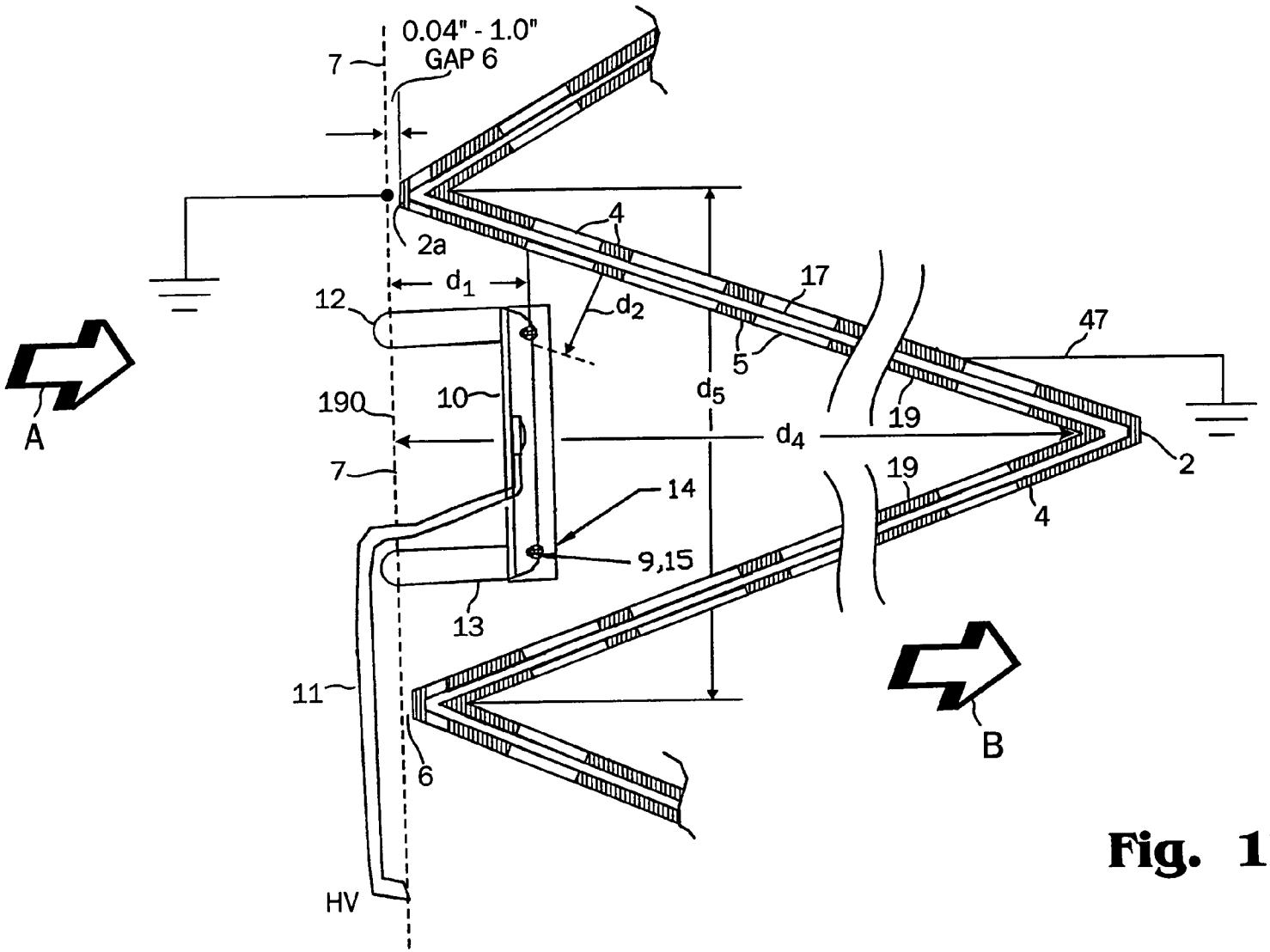
FIG. 12 shows an alternative configuration of an embodiment constructed according to the principles of the present invention.

As used in this description, the variable:

$d_1$ represents the distance between the ground control electrode 7 and the ionizing electrodes 8;

$d_2$ represents the separation between the charge transfer electrodes 8 and the ionizing electrodes 5;

$d_3$ represents the distance between the downstream ground electrodes 4 and the charge transfer electrodes 5;

$d_4$ represents the nominal depth of each fold as illustrated, by way of example, in FIG. 12, of the filter medium 1, 16 or 17, as measured between the base of the fold to the longitudinally opposite apex of the fold; and $d_5$ represents the nominal width of the base of each fold as exemplified by FIG. 12, as measured between successive upstream apices of a fold.

Figure 1A:
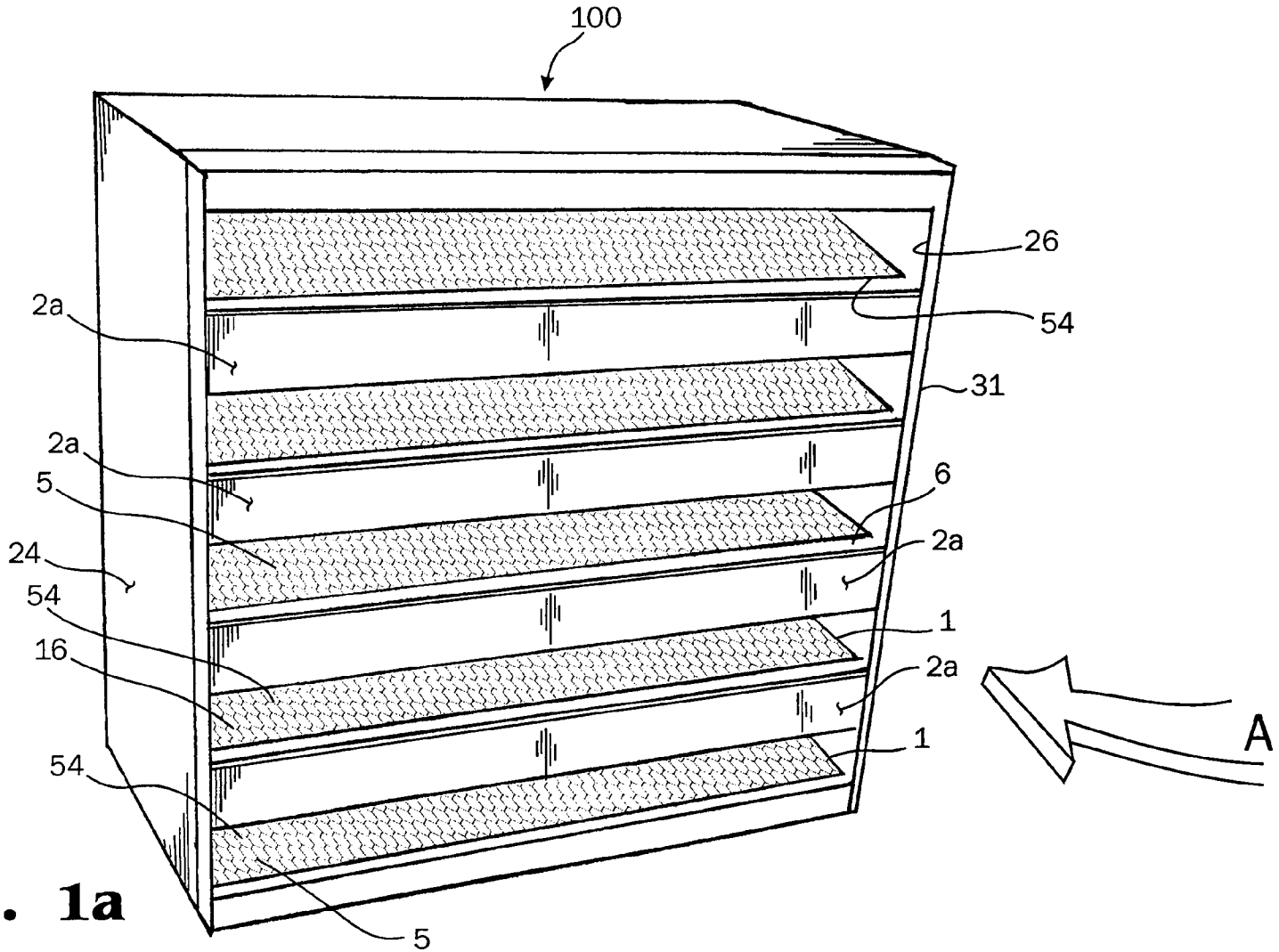
FIGS. 1*a*, 1*b* and 1*c* respectively show an elevational view of the inlet side, an enlarged elevational view of that outlet side, and an overall elevational view of an outlet side of an electrically enhanced filter constructed according to the principles of the present invention.
Figure 1B:
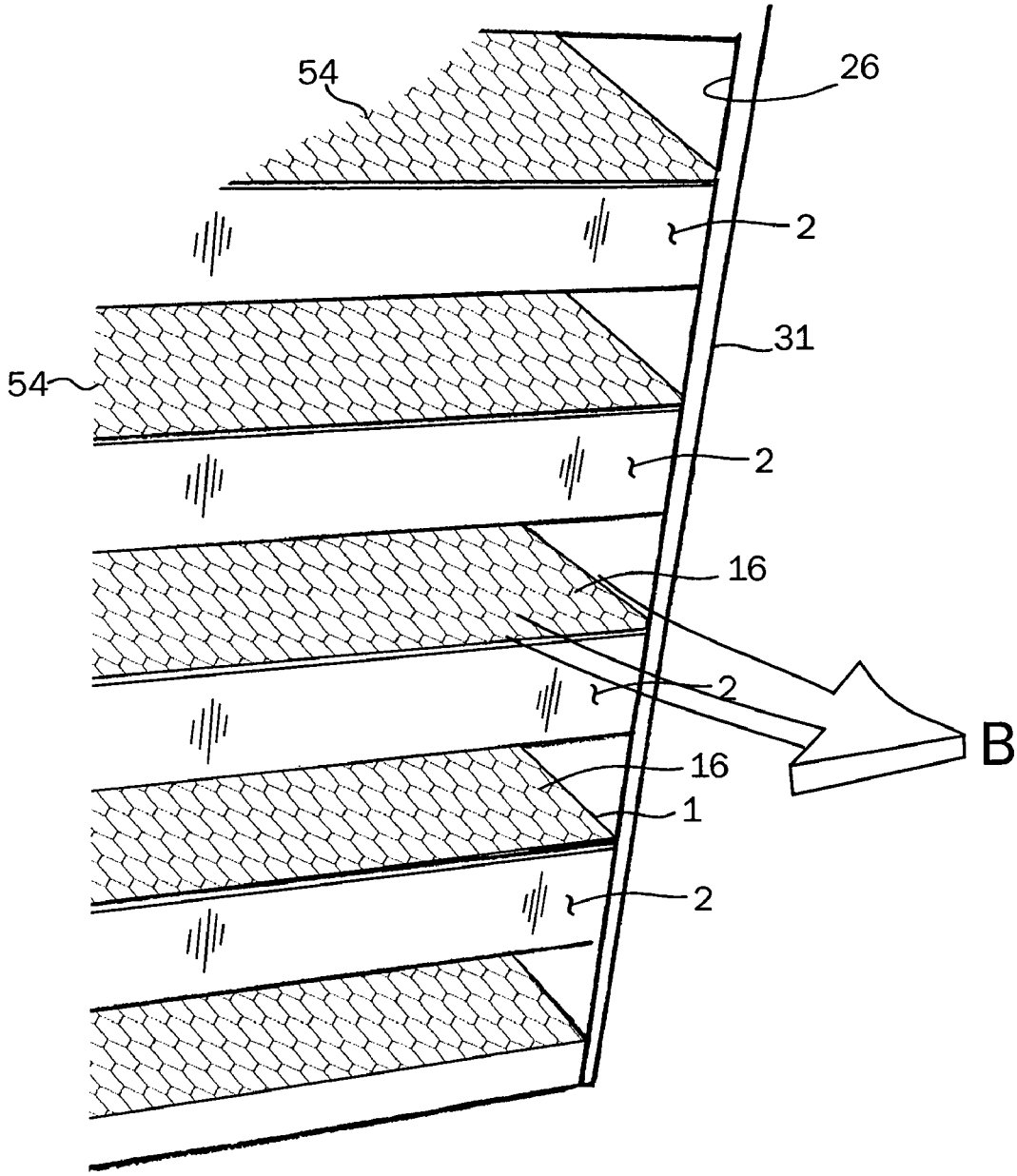
Figure 1C:
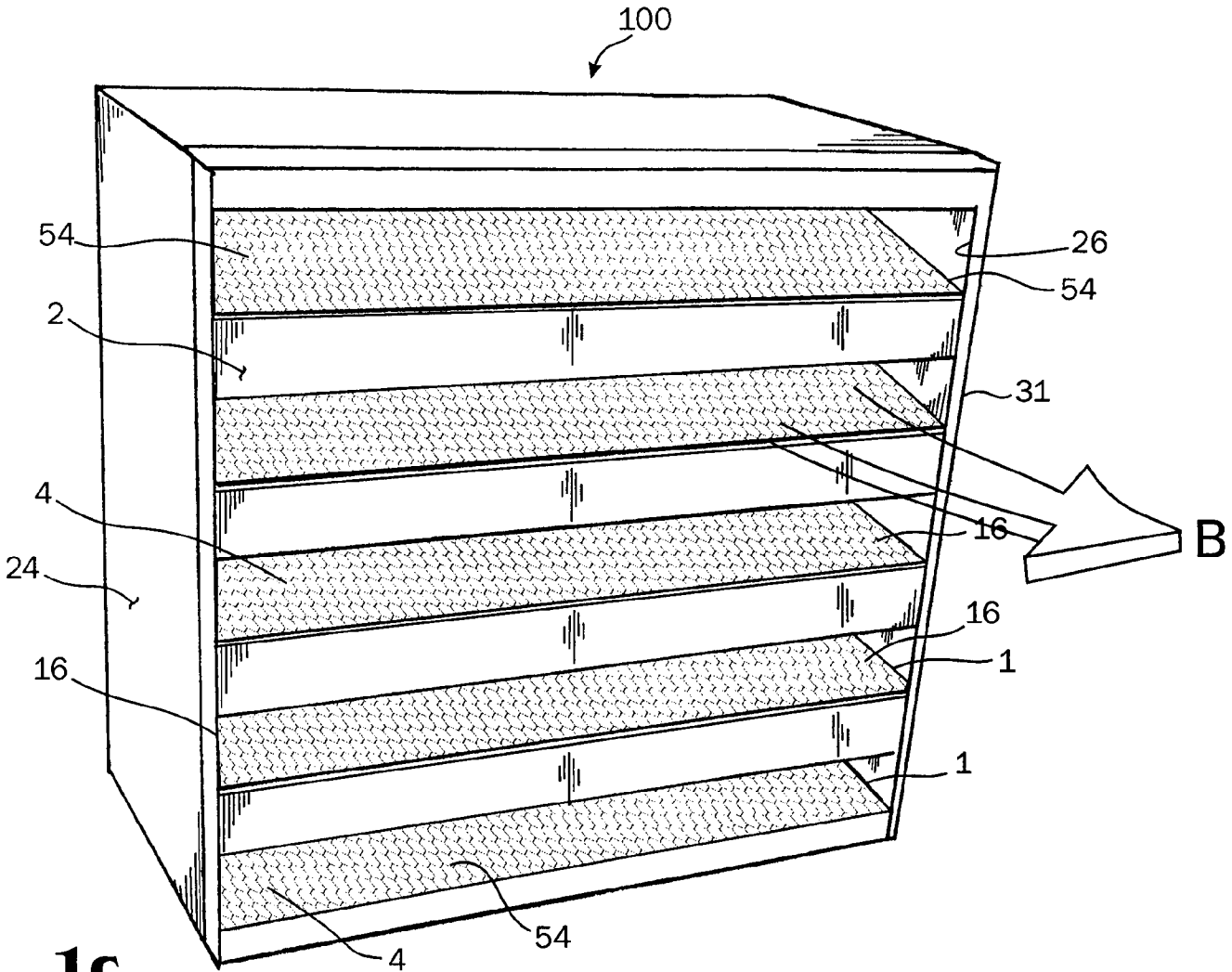
Figure 2:
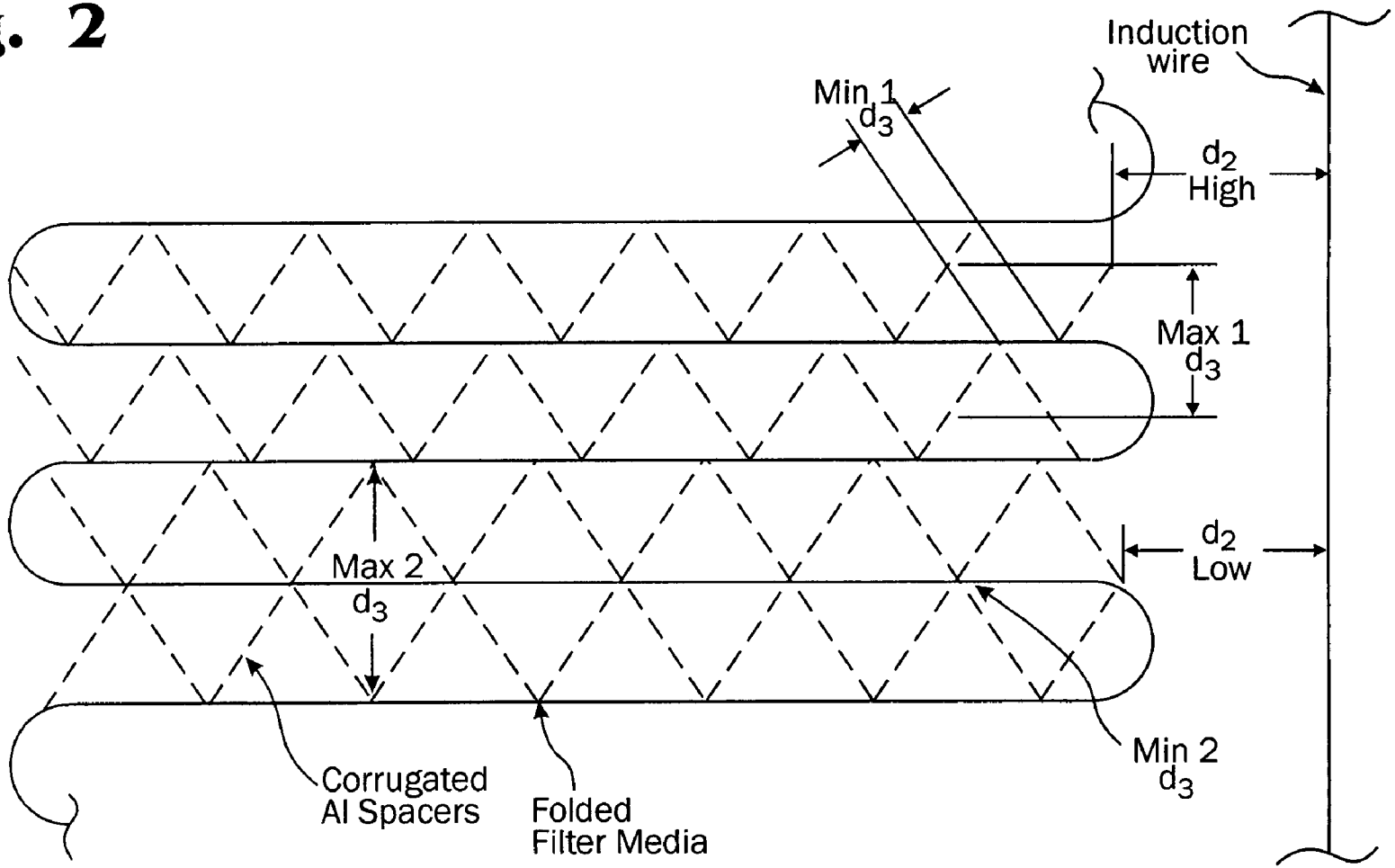
FIG. 2 shows two of the many variations in the alignment of electrodes that are possible in the construction of contemporary filtering devices.

Turning now to the drawings collectively, and particularly to FIG. 1*a*, which shows an elevation view of an inlet side of a filter assembly 31 for an ionizing field electronically enhanced filter 100 with the ionizer assembly removed, FIG. 1*b* which shows enlarged details of the downstream outlet side of filter assembly 31, and FIG. 1*c* which shows an elevation view of the downstream outlet side of filter assembly 31. Filter assembly 31 may be constructed with an exterior frame 24, that may be made of sheet metal or any other electrically conductive or non-electrically conductive material, enclosing an array formed by one, or more, deep accordion folds of a pleated filter medium 1 covered, on the upstream, or inlet side, by the pattern of a charge transfer electrode 5. Alternately, the filter folds 52, may be formed using flat mats or felts with thickness 16, or thin paper sheets 17. In FIGS. 1 and 2, the patterns of charge transfer electrodes 5 and downstream ground electrodes 4 are shown to resemble honeycombs in cross-section (as is better seen in FIG. 11); other patterns may be used for charge transfer electrodes 5 and downstream ground electrodes 4; the honeycombed pattern illustrated is only one of many perforated patterns that may be used for electrodes 4, 5 to cover the downstream and upstream exposed surfaces of filter material 1, 16 or 17. Note that in FIG. 1 only the lower portion of filter assembly 3 on the upstream side is visible. It should be noted that both the upper and the lower side of upstream surface portions of the filter assembly 31 of each pair of arms 52 forming each pocket of filter medium 1, 16 or 17 into a V-shaped fold 52 has the transfer electrode 5 applied to it. Arms of the folds 52 may also be constructed with all of the several folds formed from the same part of the continuous layer of material 1, 16, or 17.

Alternatively, end caps 2*a*, 2 encapsulate filter medium 1, 16, or 17 and possibly one or more electrodes 4, 5 extend horizontally across the inlet and outlet sides, respectively, between side frames 24. End caps 2*a* force the entrance of particulate bearing air, indicated by arrows "A", into the V-shaped pleat packs 52 only. Pleat packs 52 may be joined at an apex 50. End caps 2 on the outlet side also restricts passage of the air to the V-shaped pleat packs 52. Consequently, particulate laden air drawn or pushed into the inlet side of filter 31, passes through the broad planar areas provided by the several folds of filter medium 1, 16 or 17.

Charge transfer electrodes 5 may be formed on the exposed outer, or upstream, surfaces of the V-shaped folds 52 on the inlet side of medium 1, 16 or 17 while downstream ground electrodes 4 may be formed on the exposed, opposite outer, or downstream, surfaces of the V-shaped folds 52 on the outlet side as illustrated by FIGS. 1*b*, 1*c*. Electrodes 4, 5 may describe honeycomb grid patterns as shown in FIGS. 1*a*–1*c*, or any of various screen or grid patterns that cover the opposite exposed parallel sides of medium 1, 16 or 17, to each form a discrete, continuous electrode 4, 5 that may be maintained at a single, constant and uniform potential. Alternatively, when end caps 2 and 2*a* are used, electrodes 4, 5 may be formed by inserting flat or V shaped perforated metal plates within the V forming folds 52. The induced voltage on the electrodes 5 is then dependent on the smallest value of $d_2$ achieved. Thus an advantage of uniform charge transfer potential across the filter medium is achieved. The downstream ground electrodes 4 are then maintained at ground potential by use of a grounded clip or clips or other mechanical means. Electrodes 4 and 5 are electronically isolated from one another so that they may be maintained at different electrical potentials during operation of filter 100, and are physically separated by the thickness $d_3$ of the medium 16 or 17 of filter 1.

It is contemplated that downstream electrode 4 will be maintained at a local ground potential, while charge transfer electrode 5 will be maintained at a potential that has a higher magnitude than downstream electrode 4. Electrode 4 may therefore, be electrically connected to the sidewalls formed by frames 24 and to end caps 2, but electrode 5 must be electrically isolated from electrically conducting end caps 2*a* and from the electrically conducting frames 24 by air gaps 6. If end caps 2*a* are made from a non-conductive and dielectric material, then electrodes 5 may contact end caps 2*a*. Similarly, if the filter's frame 24 is made of non-conductive and or dielectric material, then the electrodes 5 may contact the frame 24. As is explained subsequently herein in the detailed discussion that accompanies FIGS. 4*a* through 19, an ionizer assembly 30 constructed with a plurality of parallel ionizing electrodes 8 maintained at a high voltage relative to the local ground, may be attached to the exposed flanges that frame the inlet of filter assembly 31, to locate individual ones of ionizing electrodes separated by identical air gaps having preferably identical constant distances, $d_2$, from a corresponding planar surface of charge transfer electrode 5. Alternatively the ionizer assembly 31, may have guides made using angle metal tabs that guide the assembly of ionizer 31, as described above, without fastening the ionizer 30, to the filter frame, 31. The filter frame 31 and ionizer 30 are then fastened within a filter housing by means of bolts or other means that compress the ionizer 30, frame 31 and thus also compress the filter gasket 26 against the seal plate 34. The consistency of the values of the resulting air gaps, $d_2$, allows an uniform voltage to be induced onto charge transfer electrode 5, if the charge transfer electrodes are not continuously formed (e.g., formed by using individual plates of V-shaped plates), thereby establishing an uniform electrostatic field that extends across the thickness $d_3$ of medium 16 between charge transfer electrode 5 and downstream ground electrode 4.

Figure 3:
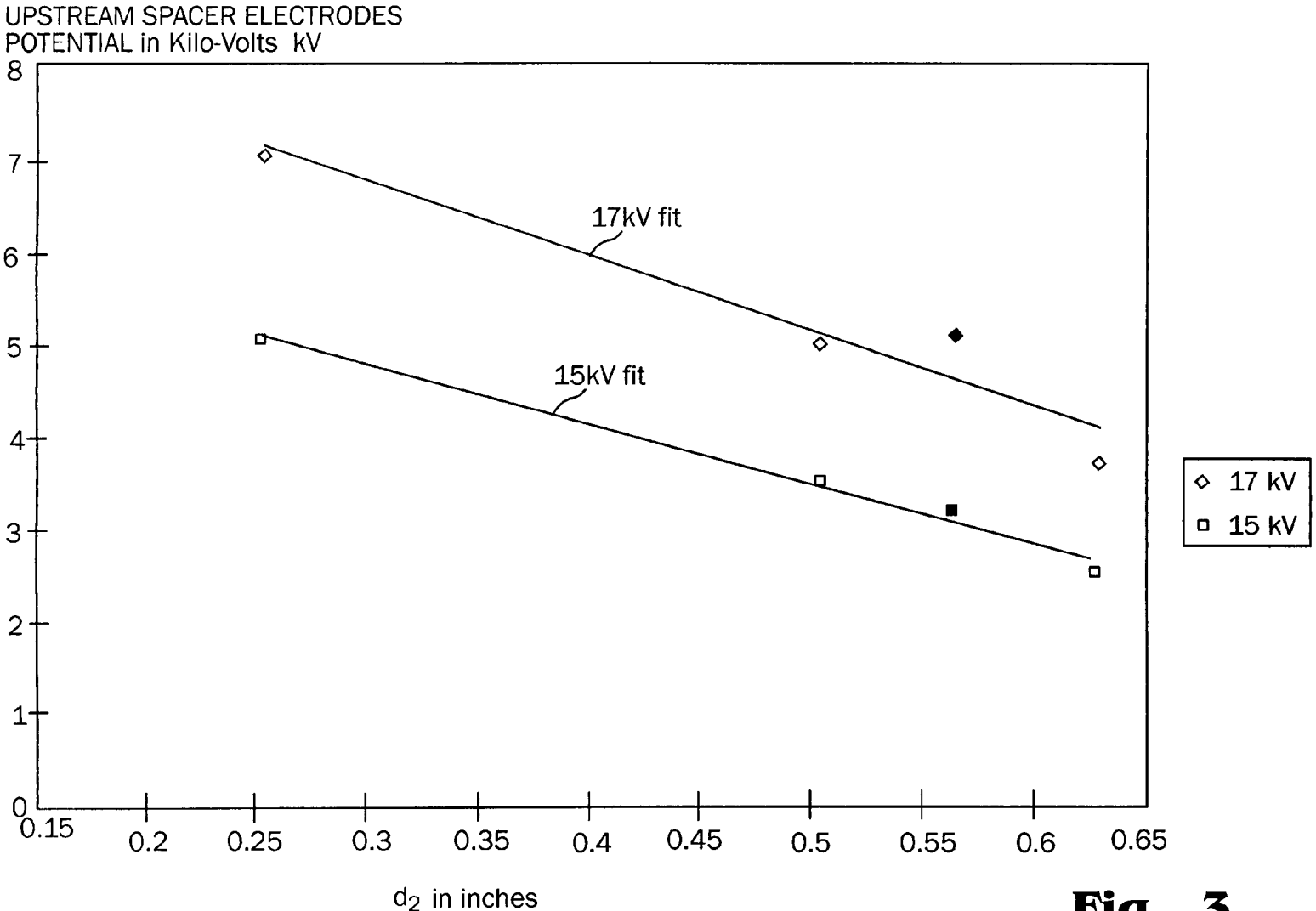
FIG. 3 is a two coordinate graph illustrating the amplitude of voltage induced on the upstream electrodes as a function of distance between the nearest ionizing electrode and the upstream charge transfer electrodes.

Referring now to FIGS. 2 and 3, I have found that with embedded upstream corrugated spacers, which are inherently electrically isolated from one another, variations occurring in the induced field depends on the distance $d_2$ between electrodes 8 and the upstream corrugated spacers at a fixed applied potential to electrodes 8. When both the tolerances in media folds and aluminum spacers are taken into account, this can mean large variations in induced potentials and hence in collection field strength and therefore in filtration performance within various sections of the filter medium.

Typically, the folded glass fiber media used in filters with aluminum separators in structures such as taught by Cheney '736, is about 0.02" thick. I have found that it is very difficult, if not impossible, to achieve identical folds that is, folds with less than 0.08" variation in fold length and identical corrugated separators, that is, tolerances of corrugation angles and cut lengths that are respectively better than five degrees and lengths better than 0.06". Recognizing that the induced electrical field depends on the least distance $d_2$ from the ionizing electrode to the upstream corrugated spacers at a fixed applied potential to the wires, when both the tolerances in media folds and aluminum spacers are taken into account, there are concomitantly large and undesirable variations in induced potentials and hence in collection field strength, and therefore erratic filtration performance within various sections of the filter medium. Moreover, the variation in the upstream corrugated spacers alignment with respect to the downstream spacers is responsible for a lack of uniform performance of the filter; the performance will vary from media section to section since the collection field strength will be inversely proportional to the local distance $d_3$ between the upstream and the downstream electrodes. This means that some sections of the filter will have very low enhancement of filtration efficiency. If deeper pleated spacers are used, this lack of uniformity and the irregularity and variation are worsened.

A high potential for sparking with contemporary filtering devices such as those of Cheney and Spurgin disclosed in their U.S. Pat. No. 4,781,736 occurs because the voltage induced on the upstream electrodes is a function of distance between the upstream electrode and the ionizing electrode. Keeping in mind that, in order to assure the prevention of sparking in such thin media, a voltage higher than about 0.35 kilovolts can not be induced on the upstream electrodes when peaks of the upstream and downstream corrugations are aligned, as shown in FIG. 2. Referring to FIG. 3, one can clearly see how daunting the task of maintaining such a precise gap between each and every one of the upstream electrodes and the inducing wire. Since the aluminum separator electrodes are simply (and thus erratically) placed, unsecured, between the media folds, it is highly likely that some of the electrodes will be too close and cause a higher surface potential on those upstream corrugated electrodes that are closer to the high voltage wire, resulting in corona discharge and sparking at points where the peaks of the upstream and downstream corrugations of the electrodes align. Sparking may burn holes in the filter media and has the potential to cause a fire if the sparking is continuous. In tests that I have done, it was practically impossible to get a filter element that had been constructed with aluminum separators to function without sparking while simultaneously achieving a significant improvement in filtration, especially under higher humidity (i.e., 60% or higher) conditions. Even if an ideal manufacturing method was developed for making filters with aluminum separators separating neighboring layers of the filter medium, contemporary practice has been unable to predictably control the distance between corrugated electrodes and the high voltage wire so that no sparking occurred and, at the same time, filtration performance was significantly improved. Moreover, contemporary practice with aluminum separators still results in significant variations in the alignment of the upstream and downstream separator peaks and valleys and thus the distance $d_3$ between the adjacent upstream and downstream electrode surfaces and, therefore, the strength of collection fields across different portions of the filter.

I have found that excessive leakage current occurs in contemporary filtering devices because the filter medium is highly porous (e.g., porosity >95%) when the minimum distance between the high voltage wire and the downstream corrugated electrode is not significantly greater than the distance between the wire and the upstream corrugated electrode, causing a considerable amount of leakage current towards the downstream corrugated electrode which is at ground potential. This will make the device inefficient. In this case, current leakage is exasperated and therefore efficiency is further reduced when the glass filter paper absorbs moisture during occasions of higher humidity.

Now consider the variation in the alignment of the peaks and valleys of the upstream corrugated spacers with respect to the adjacent downstream spacers. FIG. 2 shows two of the many variations in alignment that are possible. In one case the alignment of the peaks are off by approximately 45 degrees. This results in Min1 and Max1 distances $d_3$, between the upstream and the downstream spacers. In this case the performance will vary from media section to section since the collection field strength will be inversely proportional to $d_3$ (collection field strength=Vinduced/$d_3$). Now consider the case (which must be considered because this will occur often within the filter media folds) when the spacers are mis-aligned by about 180 degrees—i.e., peaks will coincide or almost coincide as shown in bottom section of FIG. 2. In this case of Min2, $d_3$ is equal to the media thickness and at Max2, $d_3$ is equal to twice the depth of the spacers. The maximum induced voltage on the upstream corrugated spacer electrode in their device can only be about 0.35 kilo-Volts in order to safely eliminate sparking through the media (thereby preventing damage to the media and avoiding a fire) towards the opposite corrugated electrode spacer (which is also within the pleat) at ground potential on the other side of the pleat at the point where the peaks are aligned as in Min2 $d_3$. This corresponds to a collection field strength of about 17 kilo-Volts/inch, but only when the peaks of the upstream corrugated electrode are facing (see FIG. 2) the corrugated counter spacer electrode peaks (as in Min2 $d_3$) on the opposite side of the media. A collection field strength of about 12–15 kilo-Volts/inch, is desirable for effective collection of particles on the filter media. Consider now that for the Max2 $d_3$ section of the media, the collection field strength at that section will be 0.35 kilo-Volts/0.52"=0.67 kilo-Volts/inch, if 0.25" separator corrugations (which are the smallest size corrugations) are used. This collection field strength 0.67 kilo-Volts/inch is negligible for efficient filtration of particles from the air stream. It will not be possible to induce an adequately higher voltage on the upstream corrugated electrode to compensate for this, because then the field strength at the Min2 d3 section will exceed the safe no sparking or arcing limit. This means that this section of the (Max2 d3) of the filter will have very low enhancement of filtration efficiency. If deeper pleated spacers are used, this situation is worsened. Of course, it should be noted that all sorts of situations in between these two situations can exist. Essentially, this results in a non-uniform and low overall performance. Keeping in mind that filters are mostly rated by their weakest performing section, this structural configuration will not result in high enough filtration enhancement.

Turning now to the issue of whether the structural configuration using embedded separators shown in FIG. 2 has an unnecessarily high likelihood for sparking, FIG. 3 shows the voltage induction on the upstream spacer electrodes as a function of distance from a wire electrode. One set of measurements, represented by rectangles, was taken for four different values of $d_2$ separation, with the ionizing electrode at fifteen kilo-Volts, while a second set of measurements was taken for the same four different values of $d_2$ with the ionizing electrode at seventeen kilo-Volts. Both sets of measurements were able to be fitted with linear curves, labeled respectively as 15 kV fit and 17 kV fit. Keeping in mind that the upstream electrode cannot be induced to a voltage higher than about 0.35 kilo-Volts, one can clearly see how daunting the task of maintaining such a precise gap between each and every one of the upstream electrodes and the inducing wire. In the structural configuration of FIG. 2, the electrodes are simply placed, unsecured between the media folds; it is highly likely that some of the electrodes will be closer than the target distance $d_2$ by as much as 3/16 of an inch. This will result in higher surface potential on those upstream corrugated spacer electrodes that are closer to the high voltage wire, resulting in corona discharge and sparking at points where the peaks of the upstream and downstream corrugations of the electrodes align as in FIG. 2. Sparking can also occur at other upstream and adjacent downstream alignments depending on the distance $d_2$ which would result in higher induced voltage on the upstream separator electrodes if $d_2$ was reduced due to placement of the separators. Sparking will 8 cause burn holes in the filter media and possibly cause a fire if the sparking is continuous. Exemplary efforts in the art such as Cheney '736, suggest the use of existing, commercially available aluminum separators embedded in deep pleat filters. I have found that in tests that I have done on filters constructed with embedded electrically conducting separators, it was not possible to get an aluminum separator filter to function without sparking and at the same time achieve a significant improvement in filtration, especially at normal higher relative humidity (~60% and higher). Even if a close to ideal manufacturing method for making such filters was to be developed that was able to control the distance between corrugated electrodes and the high voltage wire so that no sparking occurred, the resulting embedded filter would still demonstrate significant variation in surface potential and, therefore, variation in collection fields across different portions of the filter.

Since the filter medium used in embedded electrically conducting separators are highly porous (e.g., porosity >90–95%) and the minimum distance. These definitions have nothing to do with the downstream ground between the high voltage wire and the downstream corrugated electrode is not significantly greater than the distance, between the wire and the upstream corrugated electrode, there will be a considerable amount of leakage current towards the downstream corrugated electrode which is maintained at ground potential. Any leakage current will make the device inefficient. This situation is worsened when the glass filter paper absorbs moisture as a result of high humidity.

In order to prevent sparking towards the frame material, the frame material in the practice of Cheney '736 must be non-conductive because the aluminum spacers of the upstream corrugated electrodes will have a high probability of contacting the frame material. Typically, wood or particle board products are used. Most current manufacturing methods have switched to the use of aluminum or metal channel frames since these are non-particle shedding, result in better seals to the media, and are not flammable. Cheney '736's wood is a relatively dirty material and thus less suitable for cleanroom applications.

It should be noted that Cheney '736 does not describe any electrode gap values or ranges of voltages used in any of the configurations, nor does it provide any results showing the efficacy of the embodiments disclosed. It is highly likely that these practical difficulties and performance limitations of the Cheney and Spurgin is the main reason why such a device has never been successfully commercialized. Additionally, aluminum separator folded filter type filter elements have become unpopular because these filters tend to tear under airflow, especially during startup, due to the sharp aluminum separators within the folded media operation.

Figure 5:
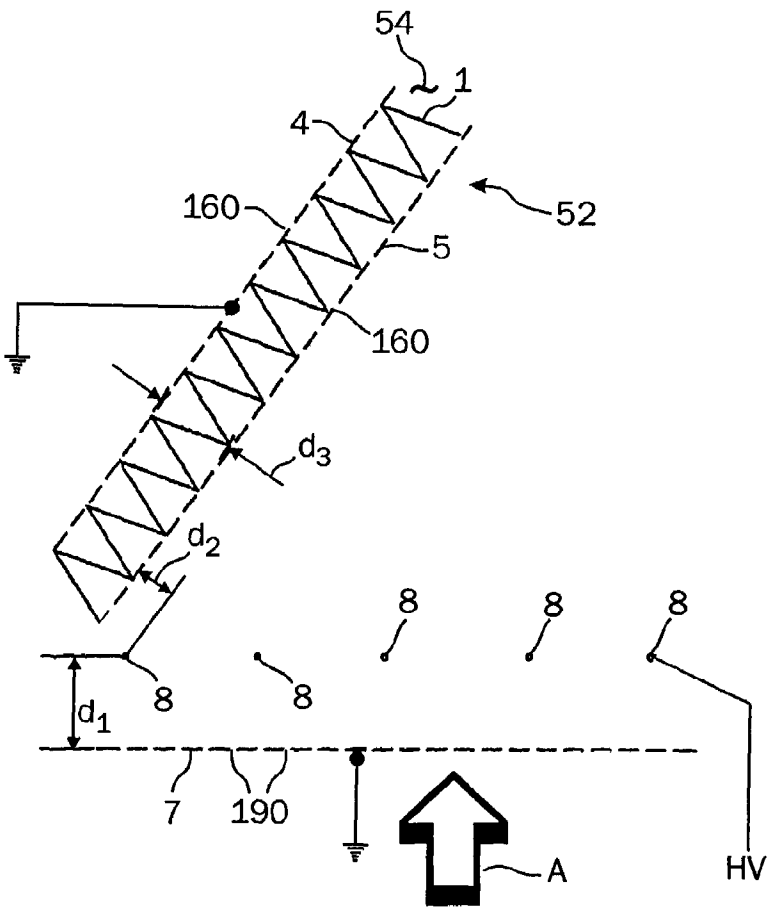
FIGS. 4 and 5 are schematic diagrams illustrating the necessity for the charge transfer electrode of the electrical enhancement of deep V-pack filters as shown by FIG. 5, in comparison with contemporary electrically enhanced, relatively shallow filters.
Figure 4:
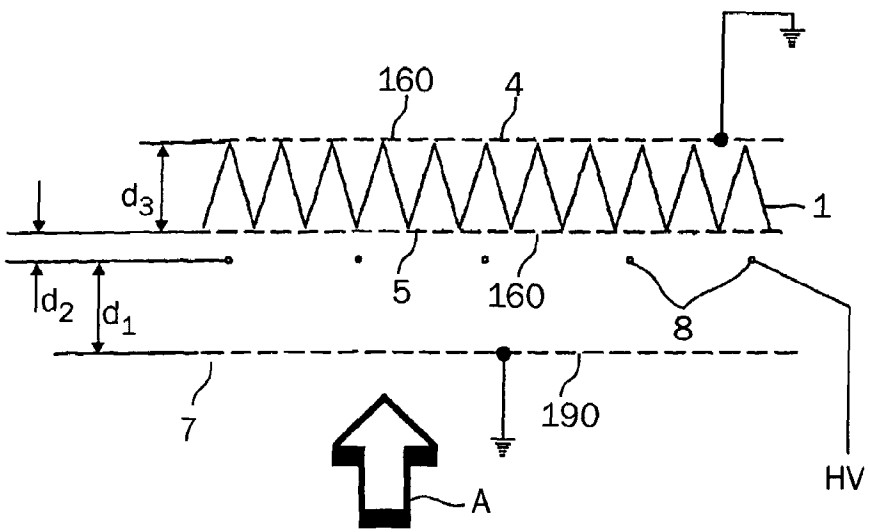

FIGS. 4 and 5 schematically illustrate several features implementing the principles of the present invention as two possible configurations of an ionizing, electrically enhanced filter modified according to the principles of the present invention with generally non-conductive filter media. A perforated, electrically conducting charge transfer electrode 5 formed as a continuous grid, is placed upon and borne by the upstream surface of filter medium 1; electrode 5 is electrically isolated from direct conduction with a local reference potential such as ground, and from any counter potential electrodes 4, 7 (which may be maintained at a reference, or ground, potential) and from the ionizing electrode 8. I have found that tests show that the surface potential achieved on charge transfer electrode 5 with the embodiment shown in FIG. 4 is the same as the surface potential on the peaks of the filter medium in the absence of electrically conductive, perforated electrode 5, which is the same result obtained in Jaisinghani U.S. Pat. No. 5,403,383. The results are summarized below in Table 1:

TABLE I

| Configuration | Applied Voltage on Wires kilo-Volts | Surface Potential due to Charge Transport, kilo-Volts | Electrically Enhanced Filter Efficiency of 95% Media |
|---|---|---|---|
| Without CTE (5,403,383) | 17 | 10.9 | 99.99% |
| With CTE | 17 | 10.8 | 99.99% |

Basically, these results clearly establish that in the "flat" or shallow depth filter configurations illustrated by FIG. 4, the addition of charge transfer electrode 5 neither aids nor affects the operation or performance of the EEF in any significantly manner.

Figure 6:
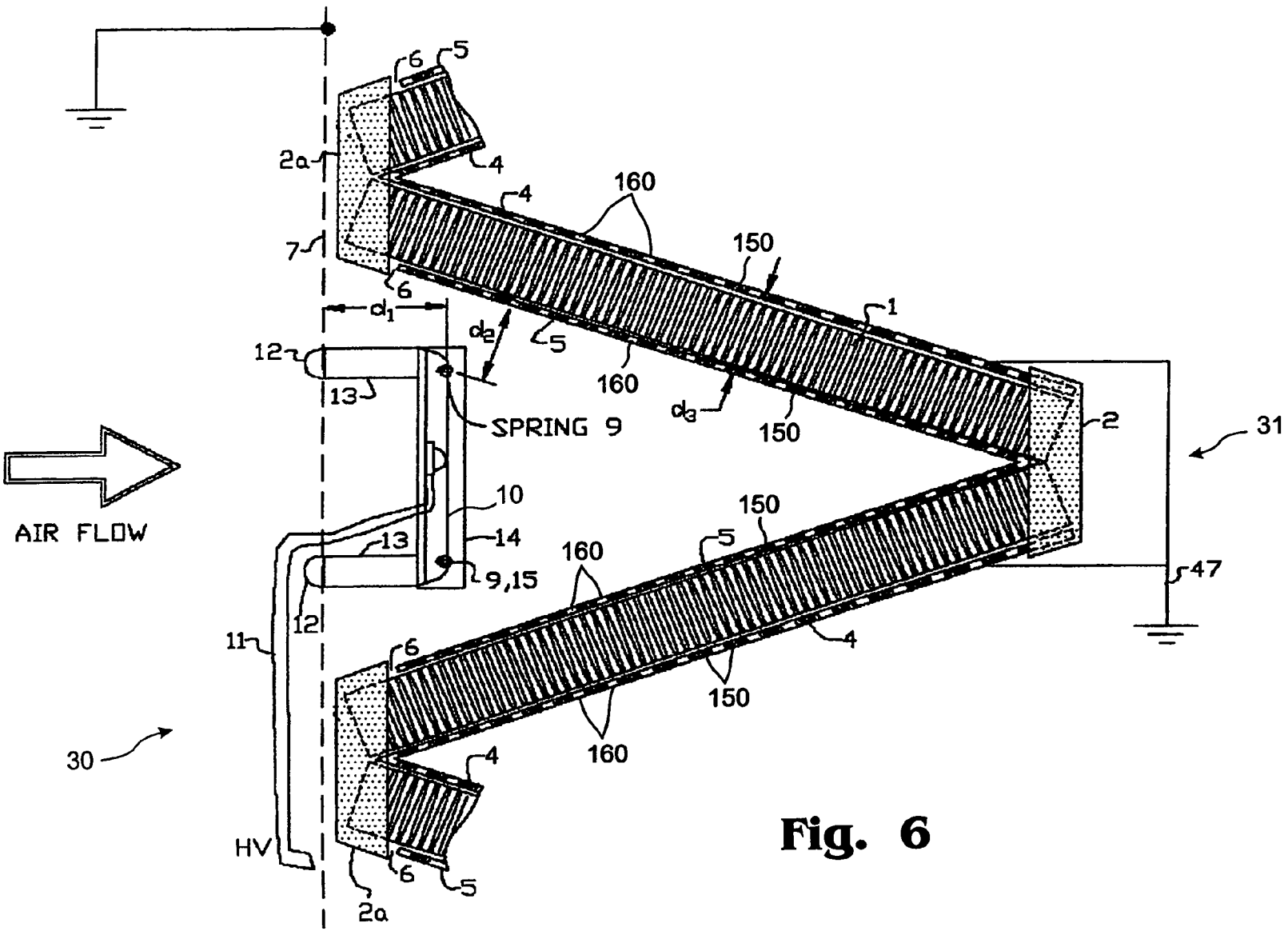
FIG. 6 shows an alternative configuration of an embodiment constructed according to the principles of the present invention.
Figure 8:
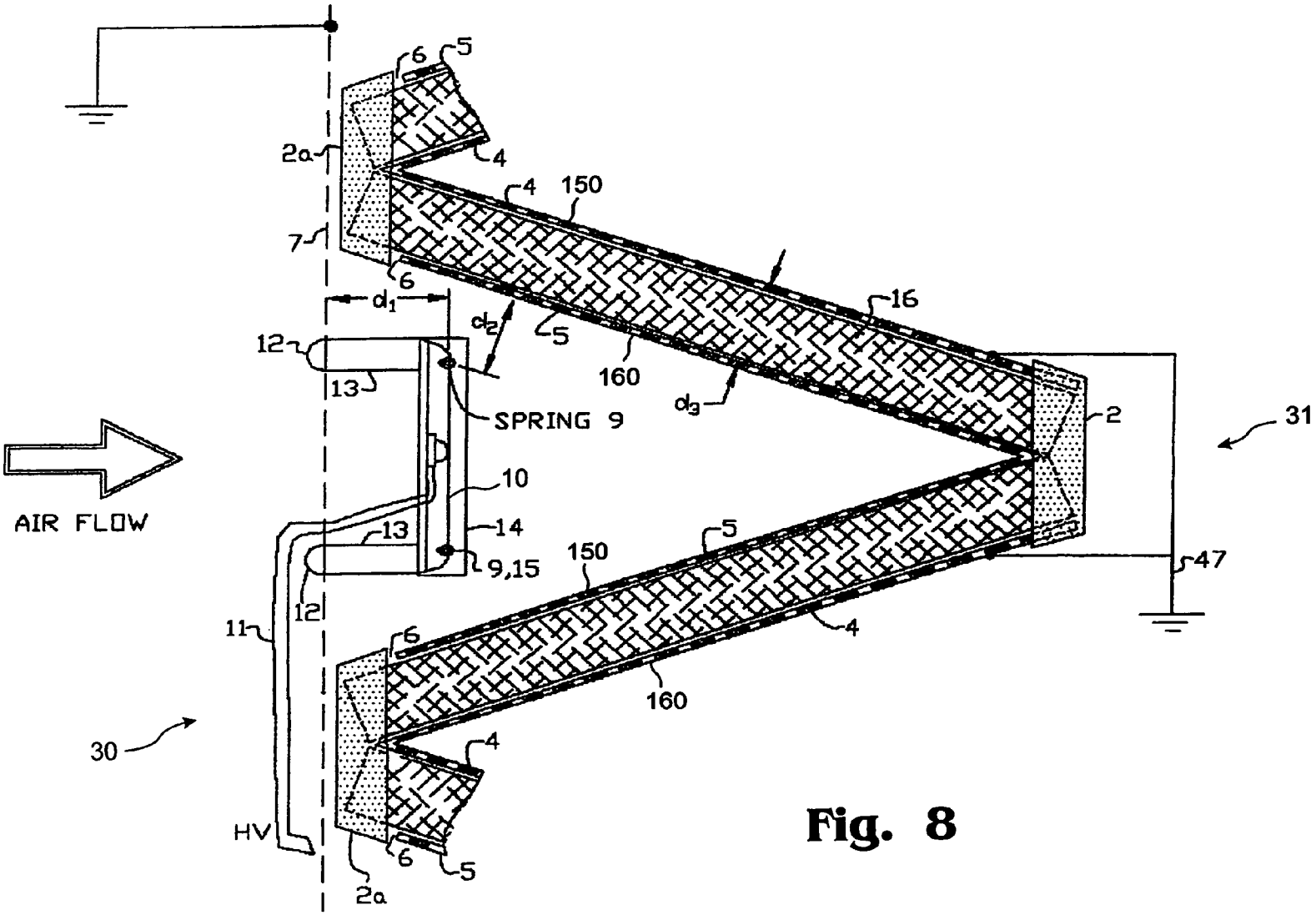
FIG. 8 shows an alternative configuration of an embodiment constructed according to the principles of the present invention.

Turning now to FIG. 5, if filter element 1 and charge transfer electrode 5 are both tilted at an oblique angle relative to ground control electrode 7 and the nominal direction of impinging airflow indicated by arrow A, and another filter medium pack 52 is added to form a V-shape, then the embodiment of this invention shown by FIGS. 6 and 8 results. In this embodiment, the distance between ionizing electrodes 8 and the control electrode 7, $d_1$, primarily determines the particle charging field strength, that is, the corona generation, which results in ion formation and charging of incoming particles carried by air entering filter 1 in the direction of arrow A.

The invention differs in the manner the particle collection field strength across the filter medium is established. In Jaisinghani U.S. Pat. No. 5,403,383 the upstream plane of the filter medium achieves a uniform charge since the distance between the ionizing wires and the upstream plane of the filter is uniform. In this invention, since the filter medium is an a V-pack formation, the closest portion of the filter medium would have the highest influx of charge while the furthest section would have the lowest or negligible amount of charge. In order to overcome this difficulty the charge transfer electrodes 5 (i.e., CTE's 5) are utilized—the discharge of ions around the ionizing electrodes 8 is collected on the electrically conductive CTE 5, primarily at the portion of CTE 5 closest to ionizing electrodes 8. CTE 5 is electrically conductive, and therefore achieves a constant and high enough potential across the upstream face of the V-pack filter media for proper collection of particles on the filter medium. This is also true if instead of the V-pack filter configuration, the other configurations shown in FIGS. 7 through 13 are used. Without the use of CTE 5, the deep filter would not function adequately because the collection field at the far ends of the V-pack (closer to the apex) would be too low.

The mechanism involved is not simple electrical induction. Referring to Table II and FIG. 16, the charge is transferred well into the exponential or corona generation portion of the curve. Unlike the Cheney and Spurgin, the resulting potential on CTE 5 is at least an order of magnitude (actually two orders of magnitude in the example shown in Table II) higher than the estimated potential that could safely be induced on the separators of the Cheney and Spurgin reference. The charge is eventually transferred across the filter to the downstream ground electrodes via the small, but finite conductivity of the generally non-conductive and dielectric filter medium. There is a net equilibrium charge accumulated however, and this results in a high surface potential, with a magnitude that is in between that of the voltage applied to the ionizing electrodes and the potential of the downstream ground electrodes, that are typically at ground potential. CTE 5 may be made of a conductive material such as aluminum or other metal, so that the potential is constant across the entire face of CTE 5. Thus the minimum distance, $d_2$, controls the value of the CTE potential for any given applied potential on the charging corona wires. Since the downstream ground electrodes and the CTE 5 are essentially parallel because they run along the planes of the filter media, the collection field strength ($V_{CTE}/d_3$) is high enough when compared to that of the flat configurations of contemporary design and also stable and constant across the filter medium, and without risk of spark discharge across filter medium 1.

The charging device, or ionizer assembly 30, significantly ameliorates the cancellation of the ionizing field ($V_{app}/d_1$) caused by the capture of highly resistive dust on the upstream control electrode. In the practice of this invention, the particles of dust would have to travel against the direction of the airflow of transient air through interstices 190 in order to accumulate on ground control electrode 7. In many contemporary designs however, the ground electrodes are parallel to the path of air flow. Consequently, the dust particles that enter the system are close to the plates and are more easily captured on the plates. The resulting accumulation of these highly resistive dust particles often causes field cancellation and back corona discharge in contemporary devices.

FIG. 6 illustrates a deep V-pack arrangement of filter medium arranged in a pleated configuration. This electrode configuration enables use of deep filter in a safe, efficient and risk free manner—something that is not possible with contemporary designs. In this V-pack arrangement, the layer of filter paper may be repeatedly folded to form a pleated filter medium 1 which exhibits numerous folds or pleats and undulates alternately between the plane of downstream electrode 4 and upstream electrode 5. The extreme ratio between the length of each pleat of medium 1 within the V-pack to the fineness of the pitch between successive pleats enables the V-pack to contain much more filter media while providing a lower pressure drop along the path of the transient air flow. Filter medium 1 is itself not deep, but is configured into a V-pack arrangement that is quite deep. Typically, the pleat length or pleat depth used is between 0.5"–2" in such V-packs though other pleat depths may also be successfully used within the scope of this invention.

Figure 10:
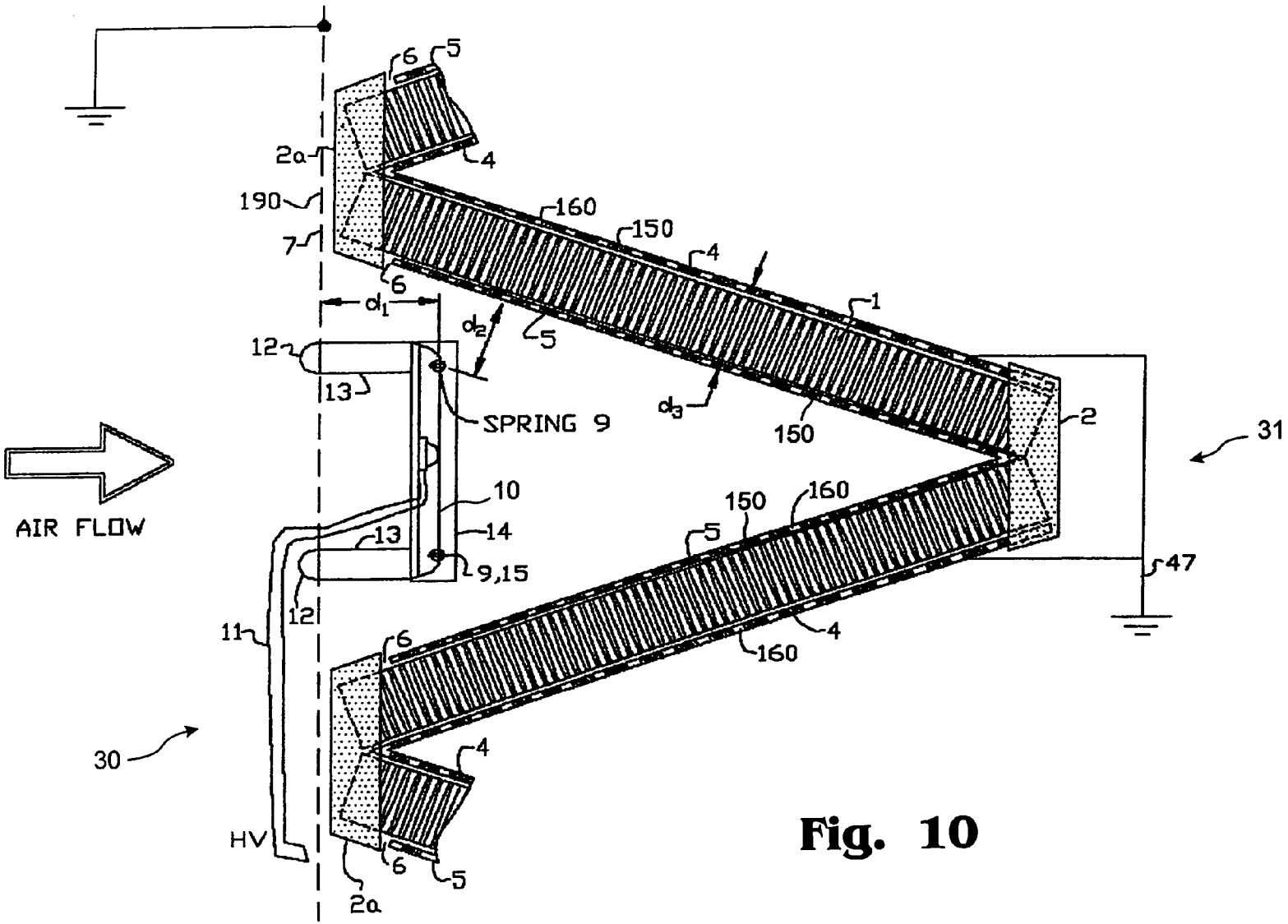
FIG. 10 shows an alternative configuration of an embodiment constructed according to the principles of the present invention.
Figure 11B:
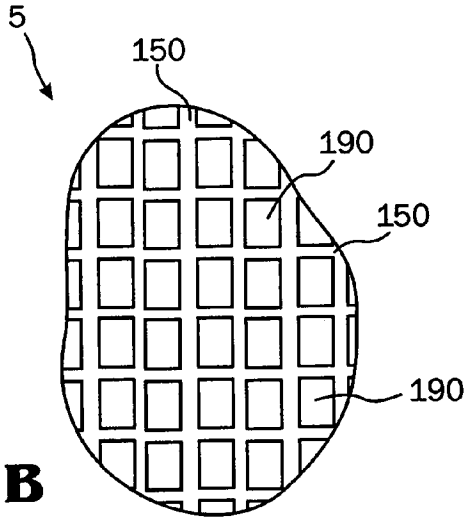
FIGS. 11A, 11B, 11C and 11D are enlarged, sectional views showing the different patterns of the electrical conductors and perforations within the electrical conductors, in various patterns that might be used as the charge transfer electrode or the downstream ground electrode for the filter element; is an enlarged view showing the printed lines that may be formed to serve as the charge transfer electrode on the filter element.
Figure 11D:
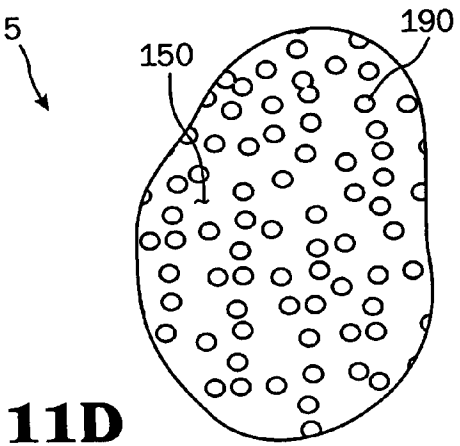
Figure 11A:
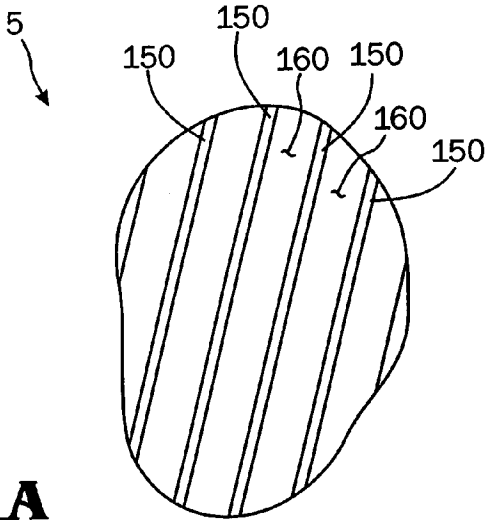
Figure 11C:
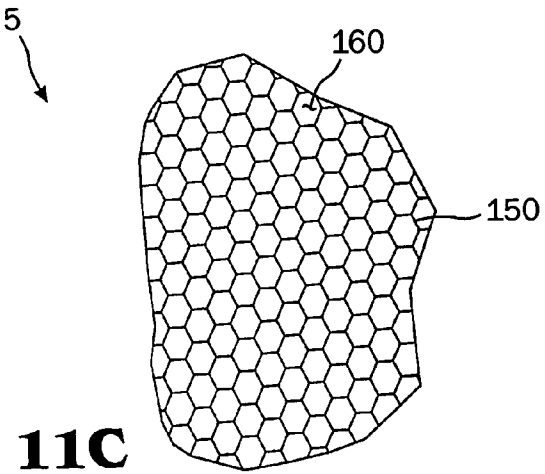

Referring collectively to FIGS. 6 and 10, a set of CTEs 5 are located on the upstream face of filter medium 1 and spaced apart from the ionizer wires 8 by a distance $d_2$. The charge transfer electrodes 5 should have no electrical contact with any other electrically conducting member. If the upstream end caps 2*a* that hold the V-packs in place are metal, then a gap 6, of about 0.25" to 0.5" (depending on high voltage) is maintained between the end caps 2*a* and charge transfer electrode 5. If the end caps 2*a* are made from non-conductive or dielectric material however, then there is no need for such a gap 6. On the downstream side, a set of perforated downstream ground electrodes (DGE) 4, are applied to filter medium 1. In this case it is actually preferred that the downstream end caps 2 be made of metal and that the downstream ground electrodes be in direct electrical contact with metal end caps 2. An electrical charge is transferred to CTEs 5 by ionizer assembly 30. Ionizer assembly 30 is a frame that is positioned so as to hold ionizing electrodes 8 preferably (though not necessarily) parallel to and spaced apart by a constant, fixed minimum distance $d_2$ from the 5.

Referring again to FIG. 6, the gap $d_2$ between high voltage ionizing electrodes 8, and CTE 5, is such that the field strength across the filter medium 1, (defined as CTE potential divided by the distance $d_3$ between CTE 5 and the downstream ground electrode (DGE) 4), is essentially the same as the field strength across medium 16 of the flat configuration as described in Jaisinghani '383. Additionally, the gap $d_1$ between the high voltage ionizing electrodes 8, and the control electrode 7, is such that charging of airborne particles within transient air is achieved—i.e., the charging field strength (defined as the potential applied to electrodes 8 divided by $d_1$) is similar to the field strength used in Jaisinghani U.S. Pat. No. 5,403,383.

In the basic mechanism of filtration enhancement, ionizing electrodes 8 are positioned within charging range $d_2$ of charge transfer electrodes 5, and charge transfer electrodes 5 become electrically charged by ion flow from the corona of ionizing electrodes 8. Downstream ground electrode 4 is maintained at a local ground potential; consequently an electrical field is established across filter medium 1, between charge transfer electrode 5 and downstream ground electrode 4. The incoming particles are charged by the first ionizing field, $V_{app}/d_1$, and some of the bacteria entering may be killed in this zone. Ionizing electrodes 8 transfer charge to the CTEs 5, and thus an adequate and safe, non sparking high collection field, $V_{CTE}/d_3$, is easily achieved across filter medium 1. Some of the biological particles, such as bacteria, collected on the filter will be killed by the electrical fields. However, the growth of almost all other common airborne biological particles collected on the filter medium will be inhibited due to the fact that these particles are held indefinitely under the high electrical fields. This provides a substantial benefit to the quality of indoor air. Typical filter V-pack filter assemblies 31 suitable for use in this invention are available from Camfill-Farr under their Filtra 2000 series, or are available from other manufactures such as Filtration Group, but without the embedded electrodes 4 and 5 necessary for this invention.

The operation of this electrically enhanced deep filter attains a reduction in the penetration of particles through the filter medium 1 by about two to three orders of magnitude. Consequently, a significantly lower resistance to the flow rate of transient air (as compared to the non-enhanced filter as in mechanical filtration having the same penetration) and an increase in filter life by about a factor of between about two to three is also achieved. The increase in the filter's life, as compared to a mechanical filter exhibiting the same penetration, is due to filter assembly 100 exhibiting a lower initial pressure drop and due to the formation of dendrites caused by the electrical field resulting in a higher porosity formation of dust layers on filter medium 1, which preserves the lower pressure drop across filter assembly 31.

The configuration using a V-pack filter assembly 31 illustrated by FIG. 6 may be compared to an embodiment of Jaisinghani U.S. Pat. No. 5,403,383 in Table II. Embodiments of Jaisinghani '383 conveniently serves as a benchmark of electrical enhancement of particle removal efficiency, albeit with the concomitant deficiencies in the embodiment of Jaisinghani '383 noted in Table II.

TABLE II

| Parameter | 5,403,383 | Deep V-pack w/ CTE |
|---|---|---|
| Vapp, kilo-Volts | 17 | 12.5 |
| $d_1$, inches | 1.45 | 1.0625 |
| Ionizing Field Strength, kilo-Volts/in | 11.72 | 11.76 |
| $d_2$ min dist from wire to media or CTE, inches | 0.625 | 0.5625–0.625 |
| Media peak or CTE surface potential, kilo-Volts | 10.9 | 5.72 |
| Media depth $d_3$, inches | 2 | 1" in a - 11.5" deep V-pack |
| Collection field strength | 5.45 | 5.72 |
| Filtration Efficiency @ 0.3 micrometers @ 300 fpm, % | 99.97–99.99 | 99.99+ |
| Filter Pressure drop @ 300 fpm face velocity | 0.85" WC | 0.25" WC |
| Filtration Efficiency @ 0.3 micrometers @ 600 fpm, % | 99.93 | 99.99 |
| Filter Pressure drop @ 600 fpm face velocity | 1.75" WC | 0.5" WC |

In both cases the filter medium used has a non-enhanced filtration removal efficiency of between approximately 92–95% for airborne particles that are 0.3 micrometers in diameter or larger.

Figure 16:
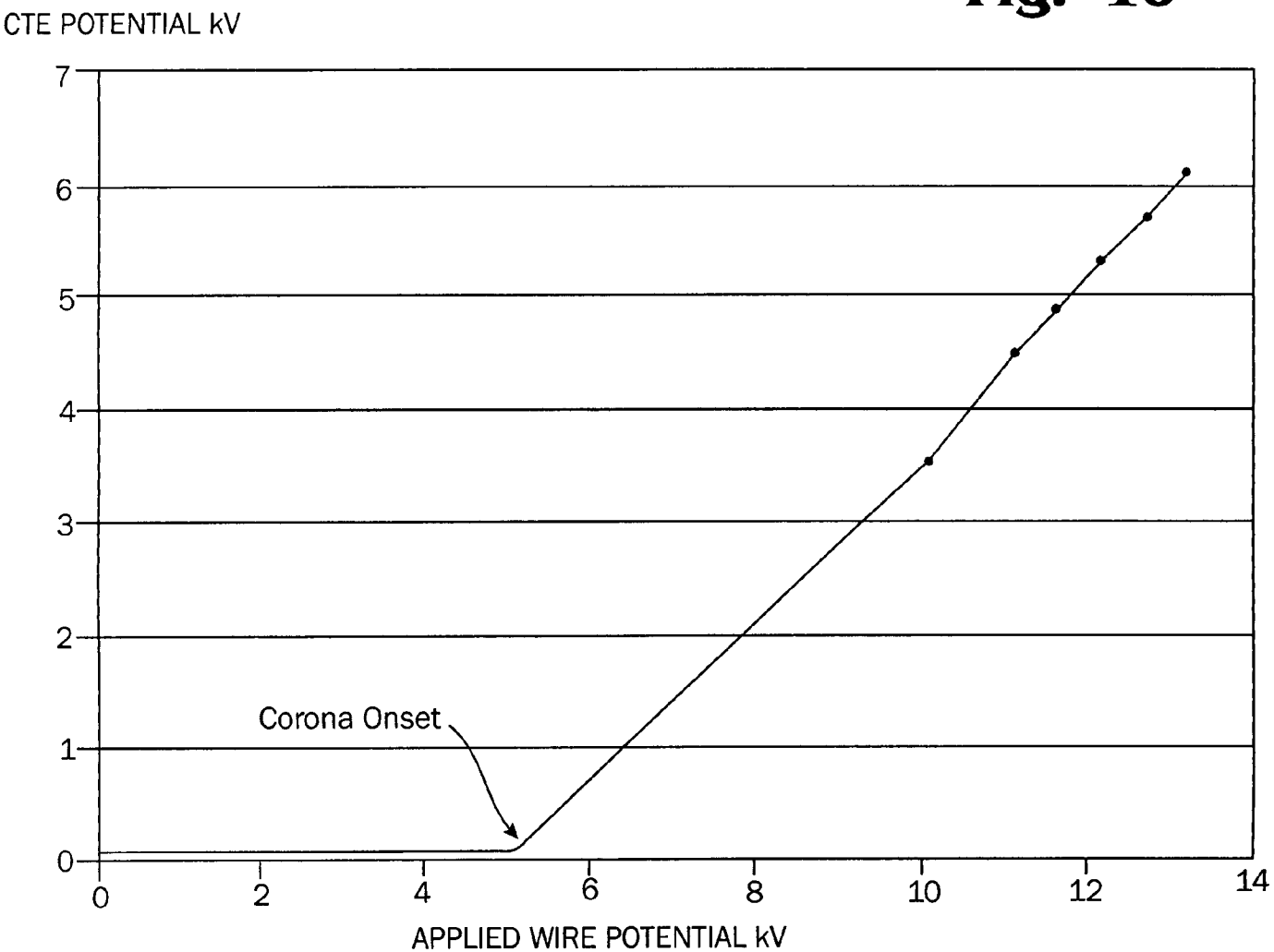
FIG. 16 is a two coordinate graph illustrating corona onset occurring as a function of the voltage applied across an ionizing electrode as measured in kilo-Volts and the voltage induced on the charge transfer electrode in kilo-Volts.

FIG. 3 illustrates how the CTE potential in a deep V-pack configuration is determined by the distance $d_2$ between the ionizing electrodes 8, and CTEs 5, for any one particular set of values for $V_{app}$ (the voltage applied to electrodes 8) and $d_1$. FIG. 16 on the other hand shows how the magnitude of the potential at CTE 5 (and therefore the collection potential across CTE5 and DGE4) increases as a function of the amplitude of the voltage applied to electrodes 8, for constant values of $d_2$ and $d_1$. It is important to note that this CTE potential as a function of applied potential is accurate only when used in conjunction with a control ground electrode maintained at a distance $d_1$ from the ionizing electrodes. As illustrated by FIG. 16, there is a region where $V_{CTE}$ is very low (near zero) and linear with respect to $V_{app}$. Once the $V_{app}$ is greater in magnitude than the corona onset voltage (the corona onset voltage depends also on $d_1$) however, then the value of $V_{CTE}$ increases exponentially with respect to $V_{app}$. This indicates that the charge transfer mechanism between ionizing electrodes 8 and charge transfer electrodes 5 is charge transport rather than simple electrical induction.

The embodiment illustrated by FIG. 6 attains higher performance at higher flow rates with lower pressure drop or flow restriction as compared to both conventional filters and embodiments of Jaisinghani U.S. Pat. No. 5,403,383.

Figure 9:
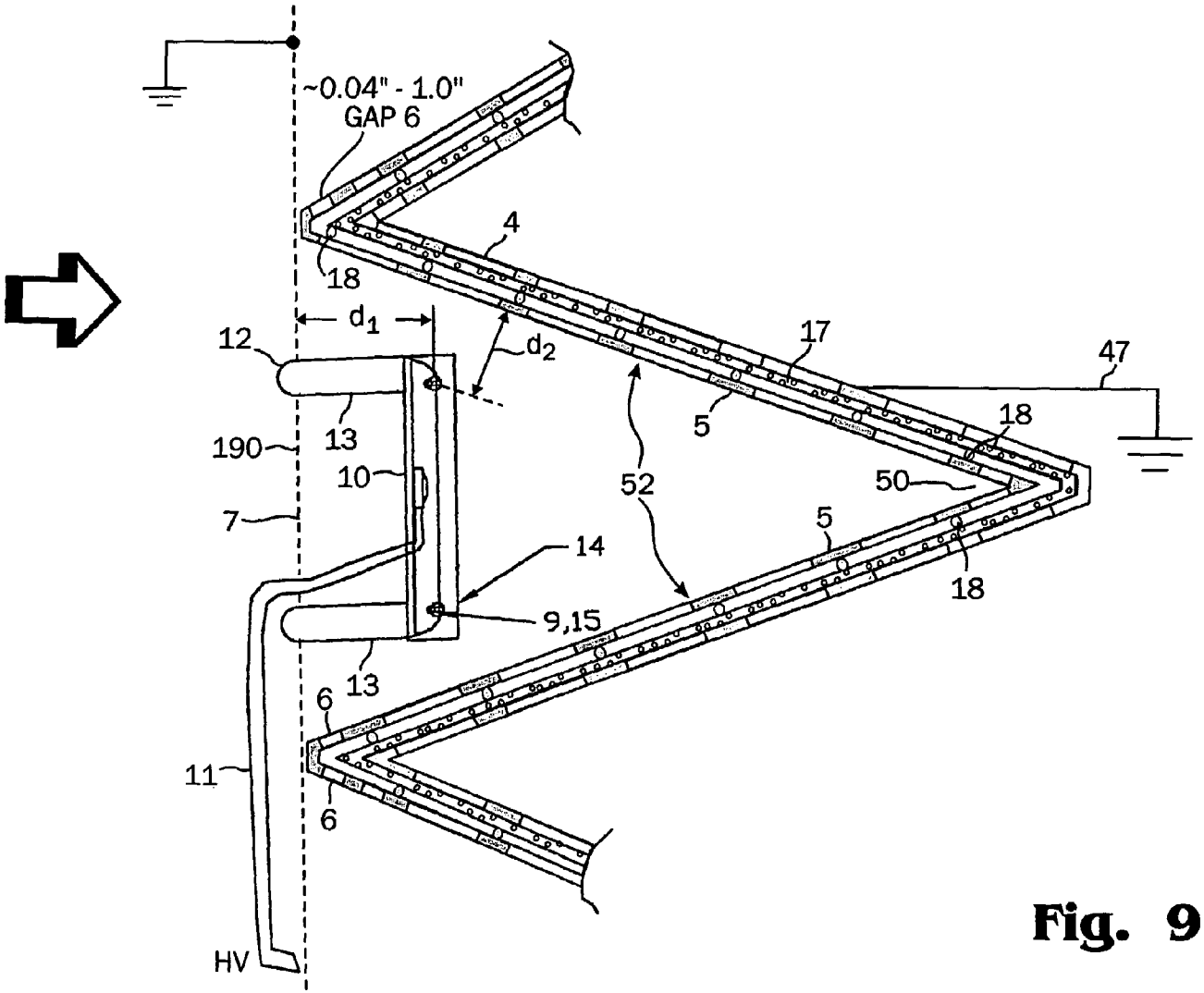
FIG. 9 shows an alternative configuration of an embodiment constructed according to the principles of the present invention.

Two other configurations are shown by FIGS. 8 and 9. In FIG. 8 CTE 5 is held against the upstream face of relatively thick (typically exhibiting thicknesses from 0.125–2"), non-pleated filter medium 16. This is one distinction between the embodiment illustrated by FIG. 8 and the configuration of FIG. 6. It is important to note that in these configurations CTE 5 is made of flat metal plates perforated by numerous interstices 160 accommodating passage of transient air, with every part of CTE 5 positioned essentially in direct physical contract with the upstream outer exposed, major surface of filter medium 1 or 16; CTE 5 does not function as a spacer and hence need not be in corrugated form as the aluminum spacers used in the contemporary designs represented by Cheney et al. U.S. Pat. No. 4,781,736. As discussed previously, with spacers that are corrugated, the field strength across the filter medium is non-uniform and can result in sparking and the burning of holes in and through the filter medium.

FIG. 8 shows the thicker, non-pleated medium 16. An example of this would be the use of flat, continuous fiber glass mats or felt of polymeric or other materials lying between essentially parallel electrodes 5, 4 in non-pleated form as a linear continuum extending between end-caps 2, 2*a* over the length of each pleat. In this configuration, although end caps 2, 2*a* are shown, it is not necessary for end caps to be used. Medium 16 can simply be folded at each end of a pleat, around the downstream ground electrode 4 or the V-shaped CTE 5, as shown in the case of the relatively thinner thickness $d_3$ of paper medium 17 illustrated by FIG. 9. If flat, conductive end caps 2*a* are used in each pleat of the construction of the FIG. 8 embodiment however, CTE electrodes 5 must have a gap of approximately, 0.25" to 0.5" between the end cap and the edge of the CTE 5, depending on the design CTE voltage, as is shown by FIG. 8.

Alternatively, the CTE 5 may contact a non-conductive end cap 2*a*. If, however, no end caps 2*a* are used (as in the wrap around electrodes shown in FIG. 9), then a gap 6 of 0.1" to 0.25" (depending on the CTE 5 design potential and the filter media thickness) is maintained between the ground control electrode 7 and the CTE 5 edge closest to the ground control electrode 7. This gap is necessary so as to prevent sparking from the CTE 5 to the ground control electrode 7.

FIG. 9 shows the configuration using non-pleated, folded, thin paper medium 17. When filter medium 17 is in a very thin paper form, even when in the non-corrugated spacer electrode configuration shown, it can become extremely difficult to assure that no sparking or electrical discharge occurs anywhere across the structure of medium 17. In that case, a small air gap between CTE 5 and filter medium 17 may be maintained so as to enable stable and safe operation. Alternatively, the air gap may be applied to the DGE 4 instead of CTE 5 to create the same effect. The gap may be maintained with spacers 18 made of a relatively higher electrical resistance glue beads, although other higher resistance polymeric spacers may also be used. It should be noted that the spacers are not separating the folds of the filter medium 17, but are spacing apart electrodes 5 or 4 from the filter medium 17. The addition of the gap enables the device to operate at a higher and more stable potential difference between CTE5 and ionizing electrodes 8. Effectively, the distance $d_3$ is increased by the non-electrically conducting, insulators 18 serving as spacers between CTE 5 and the upstream outer surface of medium 17, and this larger distance $d_3$ is compensated for by applying a higher, and more stable CTE potential which is controlled by distance $d_2$ and the ionizing field strength $V_{app}/d_1$. This assures proper and stable collection field strength for operation without arcing. The CTE may wrap around the filter medium 17 provided however that a minimum gap of 0.1–0.25" is maintained between the CTE 5 and the ground control electrode 7. Alternatively, the electrodes 5 may be shorter than the folds of the filter medium 17 by approximately 0.1 to 0.25" at the end closest to the ionizing electrodes 8. This gap depends upon the design value of the CTE 5 potential and the thickness of the filter medium.

Turning now to FIGS. 10 and 11A, 11B, 11C and 11D, either or both the downstream ground electrode 4 and the CTE 5 may be deposited as an electrically conductive pattern of electrical conductors 150 that form a grid that is perforated by numerous interstices which accommodate a flow of air or other gaseous influent through CTE 5 and the material 16, 17 of filter medium 1. Conductors 150 may be printed directly onto either or both the upstream and downstream outer surface of filter medium 1, 16 or 17 in a grid such as a honeycomb pattern shown by FIG. 11C, by using a conductive ink or paint with appropriate openings to simulate a perforated electrode. Conventional photolithographic or stamping techniques may be used to create such a pattern on either or both the downstream and the upstream surface of filter medium 1, 16 or 17. In this case there is no necessity of using metal plates for CTE 5 and DGE 4, although plates of an electrically conductive material could also be used if the pleated configuration was used with CTE 5 deposited on the upstream surface of filter medium 16 or 17 and if the conductivity of the printed CTE 5 was not high or had an intermediate level. In that case, the printing will enable a higher collection field strength without the application of a higher amplitude of $V_{CTE}$ or without reducing the value of $d_2$ to an untenably low value. All other aspects of this embodiment may be constructed similarly to those illustrated by FIGS. 6, 8 and 9. If end caps 2*a* are made from a non-electrically conducting material such as plastic, no gap 6 is necessary. If end caps 2*a* are made from an electrical conducting material, the width of gap 6 is dependent upon the charge held by CTE 5.

A dual filter layer configuration is illustrated by FIG. 12 and may be constructed according to the principles of the present invention, with an electrically conductive fibrous layer 19 which serves as a pre-filter, an electrically conductive or relatively conductive, pre filter layer 19 or a porous paper layer 19 may be used, instead of the electrically conductive metal CTE 5, on the upstream exterior surface of the non-electrically conductive filter medium 17. This conductive fiber configuration can also function as a pre-filtration device. Although FIG. 12 only shows a dual media 19, 17 with the flat filter medium 17 configuration, it should be noted that this method can also be applied to the pleated configuration of medium 1 illustrated by FIG. 6. It should be noted that when using dual media 19, 17 configuration, it is important that a small gap 6 of between approximately 0.1 to about 1.0 inches be maintained between ground control electrode 7 and conductive medium 19 which functions as the CTE charge transfer electrode.

Figure 13:
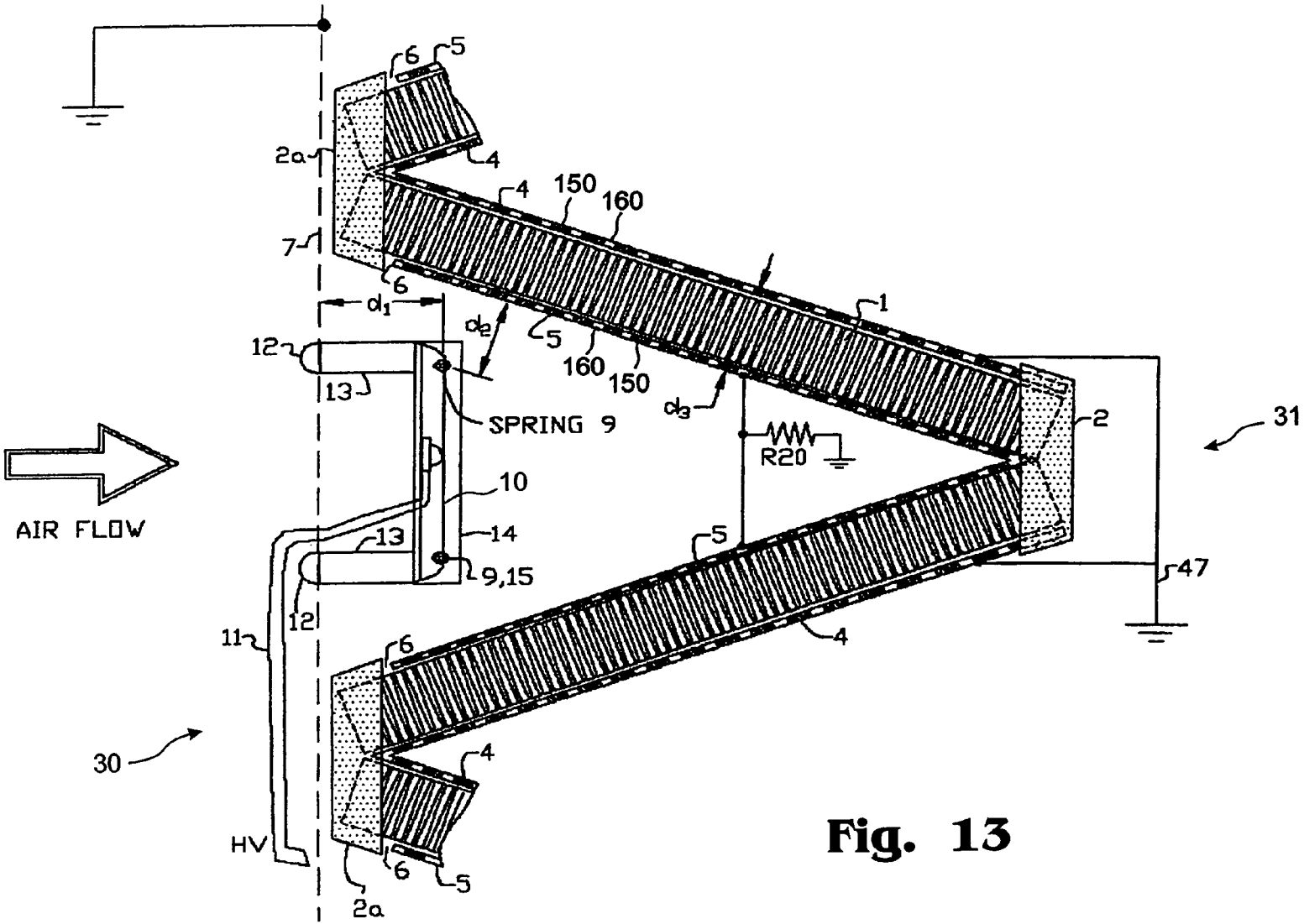
FIG. 13 shows an alternative configuration of an embodiment constructed according to the principles of the present invention.

Turning now to FIG. 13, resistive control of transfer electrode 5 may be established in order to limit the CTE 5 potential other than the local reference, or ground potential. Instead of letting CTE 5 float or be totally electrically isolated, CTE 5 may be connected to a local reference potential such as a ground or to the opposite downstream ground electrode 4 via a high resistance resistor $R_{20}$ in the mega-ohm range. Resistor $R_{20}$ is coupled in parallel to the much higher resistance of the medium 16, 17 of filter 1. This will limit the accumulated charge on CTE 5, resulting in a lower or limiting potential at CTE 5. This technique may be used to control the CTE potential in addition to varying the distance $d_2$. This technique may be useful when $d_2$ is small and slight and precise variations of $d_2$ are not practical. The use of resistor $R_{20}$ provides a secondary way of controlling the collection field strength and also ensuring the safety of filter device 1 by inhibiting arcing. FIG. 13 shows resistor $R_{20}$ applied to the configuration detailed in FIG. 6. This technique may be used in one or more of the several possible combinations with the other basic configurations described here using either flat or deeply pleated V-packs.

Figure 14:
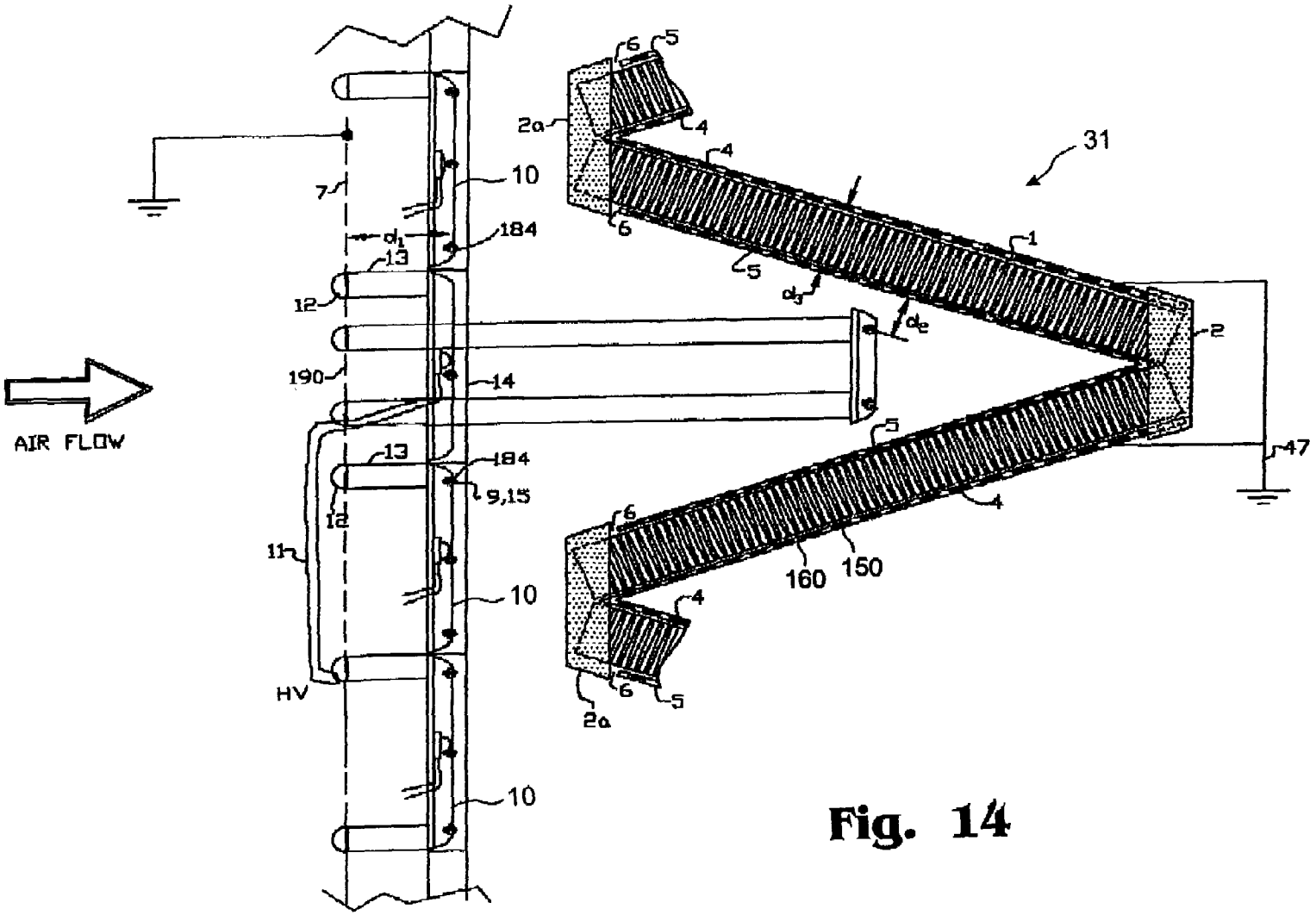
FIG. 14 shows an alternative configuration of an embodiment constructed according to the principles of the present invention.

Referring now to FIG. 14, the ionizer is constructed to provide separate ionizer and charge transfer fields. In the embodiments illustrated by FIGS. 6, 8, 9, 10 and 12, the ionizer electrodes 8 serve to both ionize the incoming gas or air based on $V_{app}$ and $d_1$ and to transfer the charge to the CTE 5, in dependence on $d_2$. In order to separately control ionization, and the charging of airborne particles and the charge transfer to the CTEs 5, a separate set of electrodes 184 on separate ceramic standoffs 13 may be used so as to maintain electrodes 184 at a distance of d1 from the control ground electrode 7. The shorter standoffs are used to suspend ionizing electrodes 184 for the particle charging field, while the longer standoffs are used to suspend the ionizer wires 8 used to transfer the charge to the CTE 5 at a distance of d2. Alternatively, a totally separate ionizer may be used and a totally separate charge transfer set of electrodes 8 may be used with separate high voltage connections to particle charging electrodes 184 and ionizing electrodes 8. In both these configuration, it may be necessary to use two different high voltage power supplies, depending on the actual design.

Referring now to FIGS. 1, 6, 15, 17, 18 and 19 collectively, the configurations described in the foregoing paragraphs may be put into practice with either deep V-pack pleated filters made with glue beads, ribbon separators or a separatorless mini-pleated filter medium 1 illustrated in FIG. 6, or with an unpleated, continuously flat filter medium 16, 17, regardless of whether the filter medium is constructed with thick felt of fiber mat 16 or with a thinner layer made of a porous material such as paper 17, as is shown by FIGS. 8 and 9.

Within each of these embodiments it is understood that variations such as the printed CTE 5 as shown in FIG. 11, resistive control of CTE potential as shown in FIG. 13, dual relatively conductive media CTE as shown in FIG. 12 and alternate ionizer with separate CTE charging as shown in FIG. 14, may be incorporated, in different variations.

Figure 15:
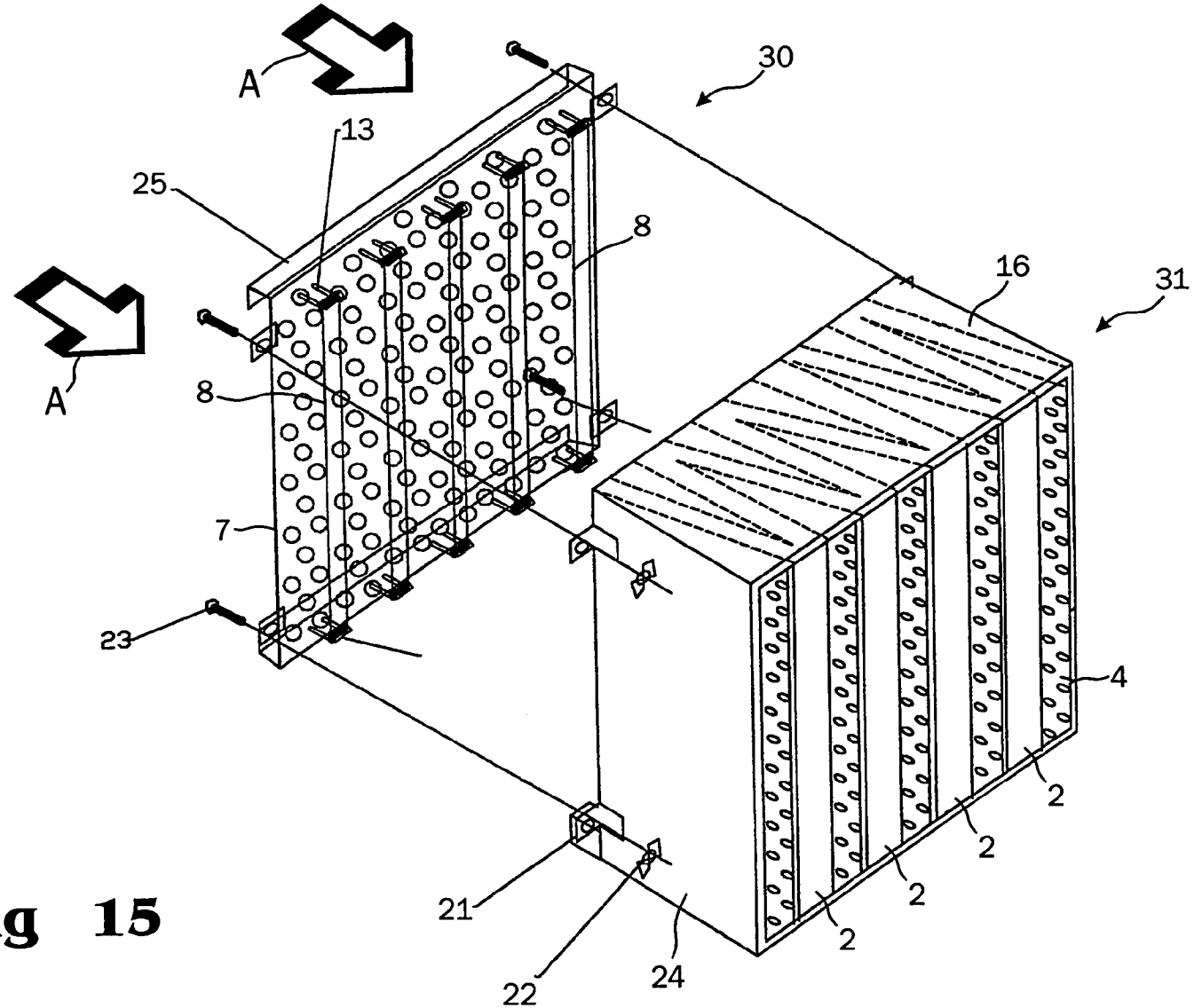
FIG. 15 is an exploded view of ionizer and filter assemblies for use with an electrically enhanced filter constructed according to the principles of this invention.

FIGS. 1*a*, 6, and 15 show a typical V-pack filter constructed by using filter medium packs 1, of approximately 1" deep glue bead or ribbon separator filter medium mini-pleats or separator-less mini-pleats arranged in a multiply folded, deep V formation so that individual neighboring pairs of the folds form the apex of the V within a downstream end-cap 2. The packs are typically sealed within the end cap using a polymeric flexible adhesive 3 such as urethane plastisol. The transverse surface of the packs and the ends of the end-caps are sealed to the filter frame 24 by potting the packs and the end-caps to the frame of the V-pack using similar adhesives. The frame of the filter is typically made using aluminum or galvanized channels and clips 27 which hold it together. The insides are potted with a urethane or other similar adhesive to form a solid frame that is sealed to prevent detectable leakage.

Figures 19, 19A:
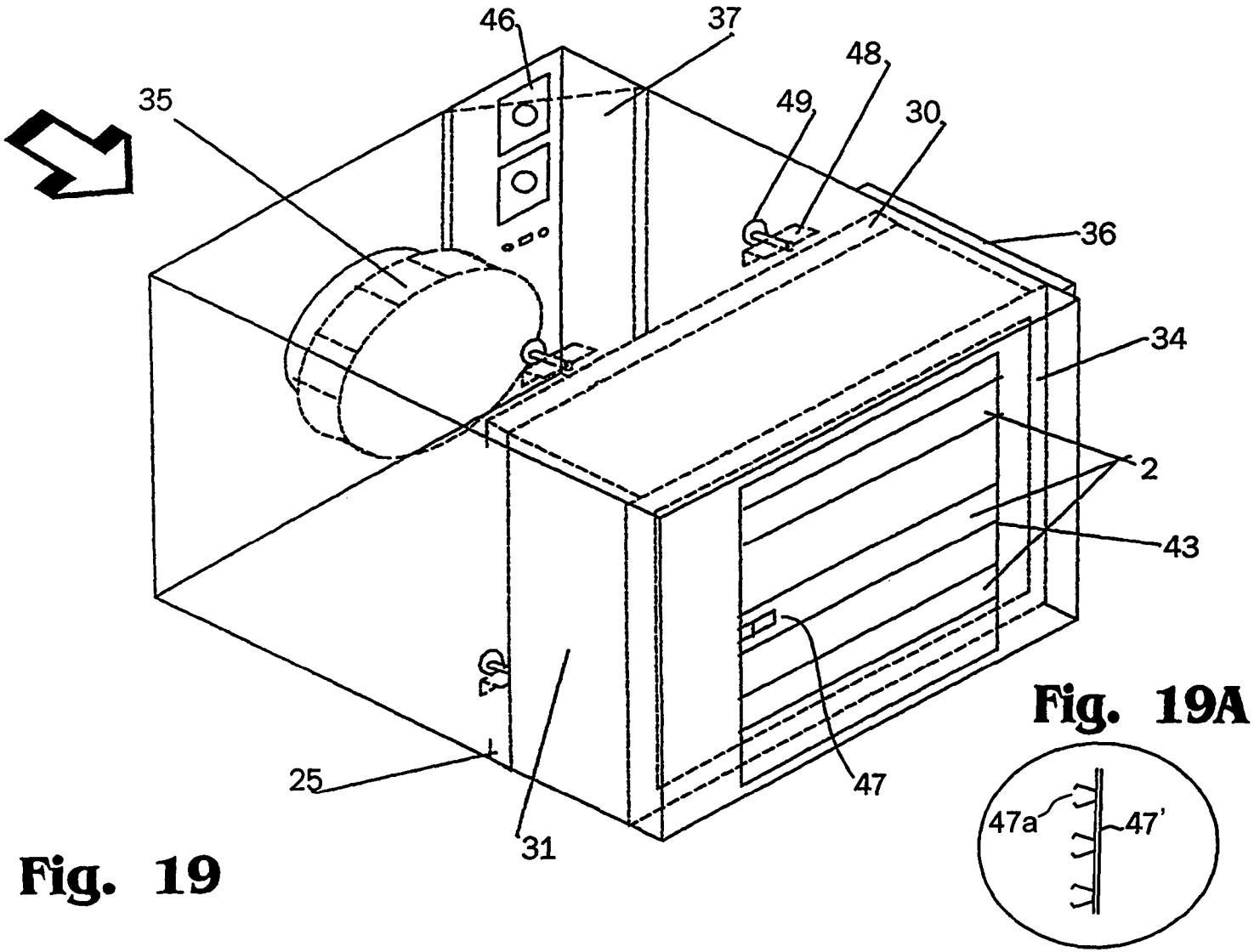

End caps 2 shown by FIG. 1*b* on the downstream side of the filter are preferably made of an electrically conductive metal, which is in electrical continuity with the metal framing material or channel that encompasses the filter as a housing. The downstream ground electrode plates 4 are inserted within end caps 2 in electrical contact to provide electrical continuity with end caps 2 which are maintained in electrical continuity with the conductive frame of the filter. Thus, only one point on the frame of the filter needs to be grounded or set to a opposing potential in order that all of the downstream ground electrodes plates 4 will be at the same potential. This grounding may be typically accomplished by a metal grounding clip 47, which contacts the filter end caps as the filter is tightened against the seal plate 34 as shown by FIG. 19. Different mechanical devices that enable ground contact may also be used in lieu of grounding clip 47. If the filter frame or end cap 2 is made of non-conductive material or if contact of the downstream ground electrode 4 with the end caps 2 or contact between end caps 2 and filter frame is not feasible, then instead U-shaped grounded metal or conductive clips may be used to make frictional contact with each of the ground electrodes 4 at the apex of the V-packs. Thus each U shaped clip can provide ground coontact for two of the ground electrodes (which cover 4 surfaces of the filter packs) if the ground electrodes 4 are in a V shape i.e., they are continuous between two adjacent surfaces of the V-pack filter.

End caps 2*a* on the upstream side as shown by FIG. 1*a* are preferable made of a non-conductive material or plastic extrusion. In this case, CTE plates 5 can then be maintained securely within upstream plastic end caps 2*a*, and gap 6 shown in FIGS. 1*a*, 6 and 8 is not then required. Thus, since the entire inside of the V-pack is potted with a non-conductive plastisol, the CTE plates 5 are essentially maintained in electrical isolation, provided however, care is taken to ensure that the CTE plates 5 do not contact the frame. It is, however, not essential that upstream end caps 2*a* be made of a non-conductive material. It is possible to use metal end caps as in the downstream end caps, provided that CTE plates 5 are not in electrical contact with elements of filter 31 that are at a different potential, and gap 6 is maintained with these metal end caps 2*a* shown by FIG. 1*a* and FIG. 6. Typically, a separation distance of about 0.25"–0.375", that is, gap 6, is maintained between CTE plates 5 and metal end caps 2*a* to ensure that there is no electrical discharge and proper isolation of CTE plates 5. This, then enables easy conversion of a manufacturing process that is already set up to manufacture conventional V-pack filter elements with metal end caps only.

The non-pleated filter medium 16, 17 maybe incorporated into a non-pleated configuration suitable for use in lower efficiency filtration applications, although non-pleated filter media may be adapted to higher filtration applications also. The filter medium may be in a flat, continuous thick mat or felt form 16 as shown in FIG. 8, or in thin paper form 17 as shown in FIG. 9.

Figure 17A:
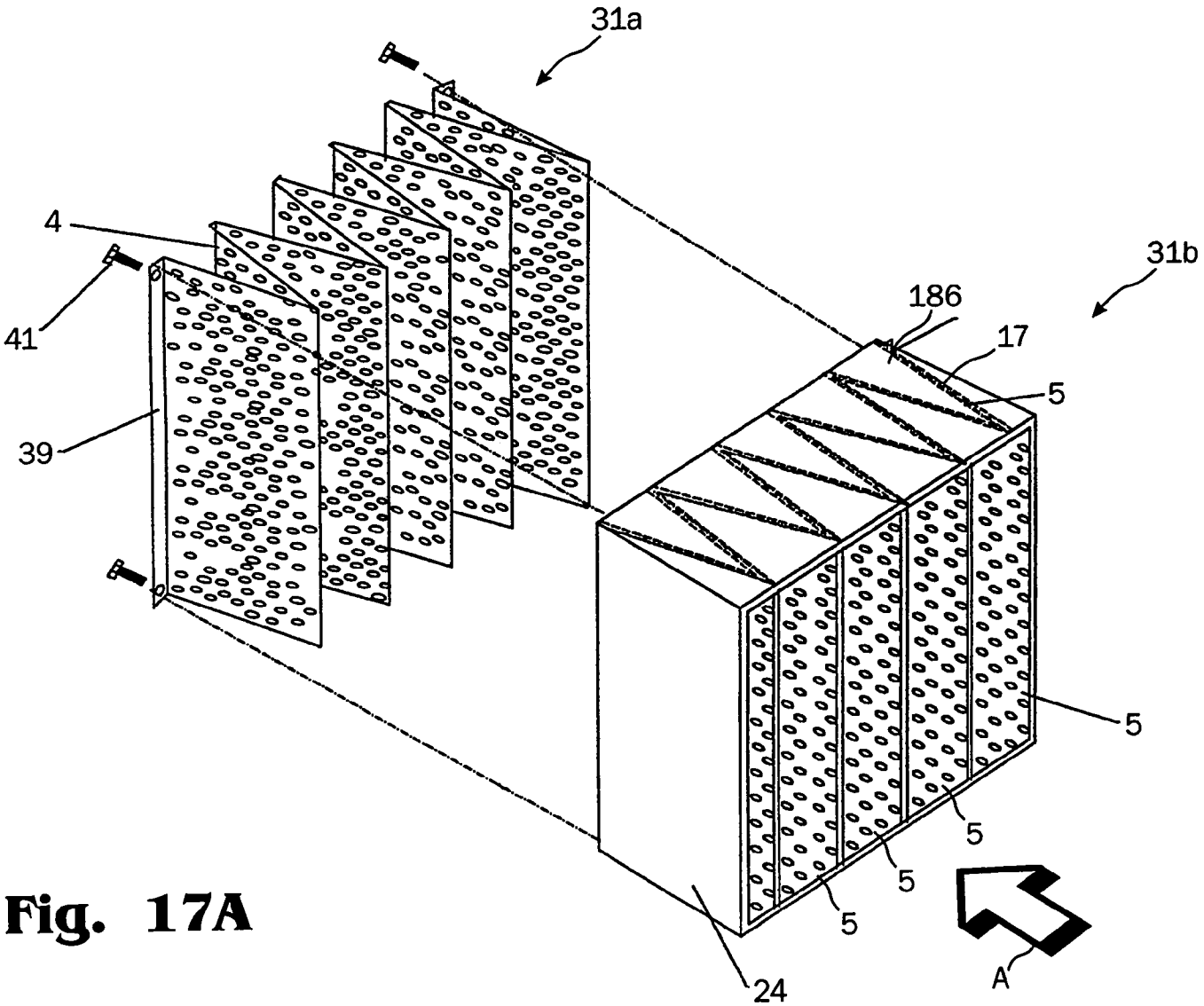
FIGS. 17A and 17B illustrate two of three techniques for constructing and installing filter material in the filter assembly; is an exploded view illustrating two alternate embodiments of filter media elements constructed according to the principles of the invention.

FIG. 17A shows one embodiment of the filter assembly 3 with filter medium 16, 17 bonded into the preferably non-electrically conductive frame of filter assembly 24 to form a potted filter element 186 via a plastisol or other adhesive as in the case of the V-pack filter described above, with filter medium 16, 17 maintained in direct contact via light bonding by means of an adhesive to downstream ground electrodes 4 which is in an electrically conductive, continuous, deeply pleated or corrugated and perforated form. CTE 5 may similarly be a continuous deeply pleated or corrugated and perforated, electrically conductive member that is then attached to the frame 24 such that it is in essential contact with the filter medium, or if the filter medium is very thin paper, depending on the electrical design, a small gap 18 of about 0.04" to 0.25" may be maintained between CTE 5 and the upstream surface of filter medium 17 in order to achieve charge stability without risk of spark discharge. Glue beads 18 may be used on the CTE 5 to also ensure this separation distance between medium 17 and CTE 5. This embodiment is a throw-away filter and is deployed for high filtration efficiency applications. Downstream ground electrode 4 which is also a continuously deeply pleated and corrugated and perforated, electrically conductive member, is removable and is designed to fit into the pleated form 5, which is constructed as a discrete member, such that there is enough room for filter medium 17 in between CTE 5 and electrode 4 when the downstream ground electrode 4 is attached to the frame via a set of screws 41 or other fasteners such as clips.

Figure 17B:
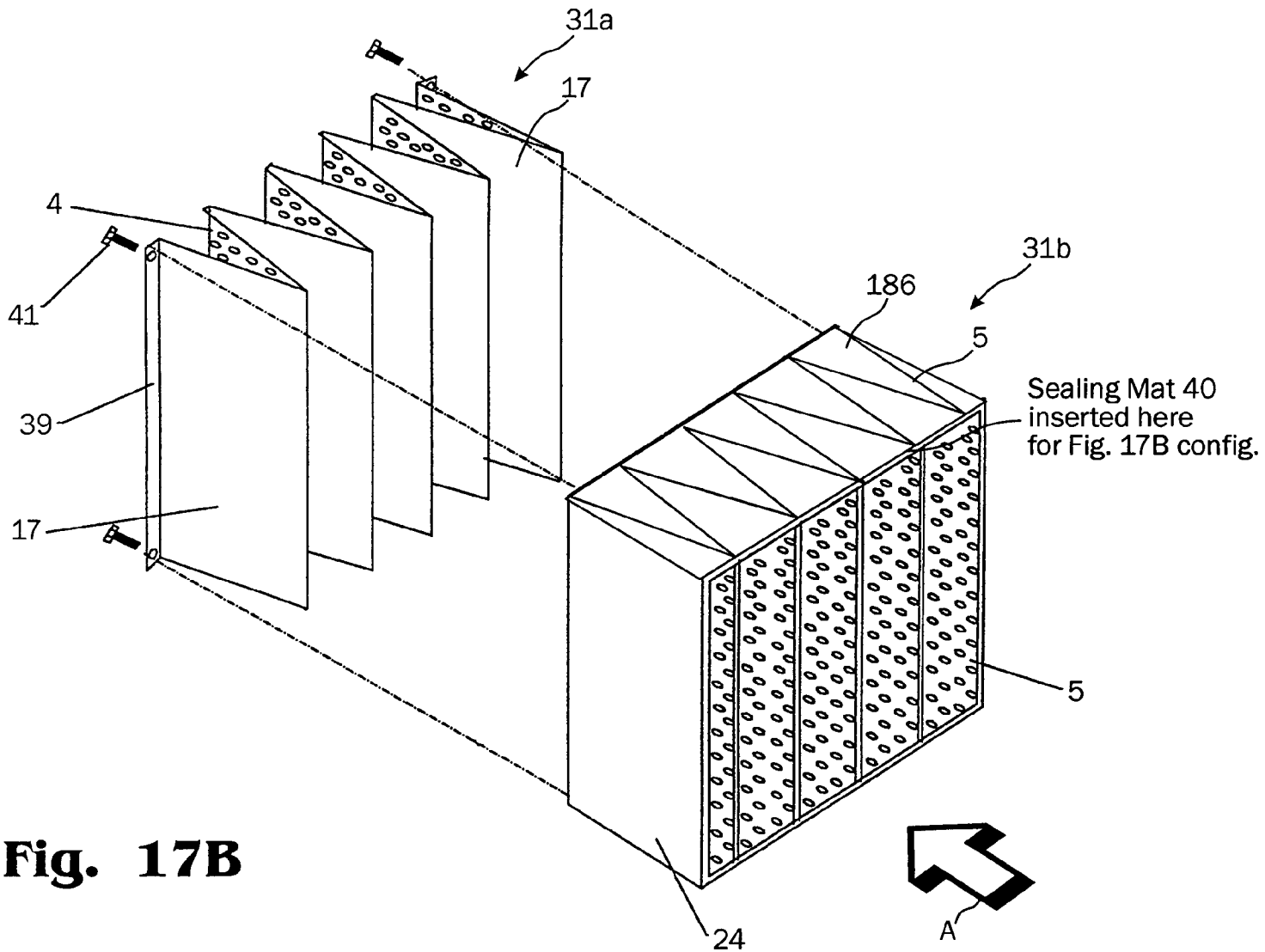

FIG. 17B shows the non-pleated media 16, 17 embodiment 188 which enables a user to simply replace the filter media when it gets dirty with entrapped particles, rather than throwing away the entire filter assembly. Consequently this embodiment is usually not deployed for high filtration efficiency where high filtration efficiency is defined as applications for filtration providing greater than approximately 95% particle removal at sub-micron particle sizes. Non-conductive frame 24 which may be part of a filter housing or may be a separate component within such a housing, is used. CTE 5 is attached to this frame and is in a continuous deeply pleated or or corrugated and perforated conductive form. Downstream ground electrode 4 which is also a continuously pleated and perforated, electrically coductive member, is removable and is designed to fit into the pleated form of CTE 5, which is constructed as a discrete member, such that there is enough room for filter medium 17 in between CTE 5 and electrode 4 when the downstream ground electrode 4 is attached to the frame via a set of screws 41 or other fasteners such as clips. Downstream ground electrode 4 has a flanged edge 39 which is sealed along with the filter medium against the edge flange of filter frame 24. The other perpendicular edges of the filter medium 16, 17 are relatively sealed to the frame by a layer of fiberglass or mat 40 or another material, that is able to prevent the passage of dust, that is glued to the top inner and bottom surfaces of filter frame 24. Alternatively, the system can be designed such that CTE 5 is removable and the downstream ground electrode 4 is fixed into the filter frame. Alternatively both the CTE 5 and ground electrode 4 may be removable. Other techniques may also be used to enable filter media replacement in the practice of this invention.

If a very thin filter medium 17 is to be used, then CTE 5 and downstream ground electrode 4 may be fitted with fastening points to the frame 24 so that there is there is space between the CTE 5 and electrode 4 for the media plus about 0.04"–0.25", depending on the design of CTE 5 and the voltage applied to CTE 5. Typically the filter medium used is attached to the downstream ground electrode 4 or the CTE 5 member by means of either Velcro® strips attached 21 to various points on the electrodes and on corresponding points on the filter medium or is simply pushed and maintained against the ground electrode 4 by the CTE 5 (or vice versa) or the members for creating the space described above, attached on the CTE 5. For improved contact to ground the filter medium 17 may have portions of it covered with conductive paint either by printing a pattern on it (similar to the printed CTE 5) or just along the edges of the folds. This conductive coating can assure better ground contact on the downstream side of the filter medium 17. Filter medium 17 is usually manufactured with folds or creases, which coincide with the pleats or corrugations or folds of downstream ground electrode 4 to facilitate attachment of the filter medium to downstream ground electrode 4 or CTE 5. To replace filter medium 17, the downstream ground electrodes 4 or CTE 5 is detached from the frame 24 and the dirty filter medium is replaced with a clean new folded medium.

FIG. 15 is a blown up view of ionizer 30 and filter assembly 31 illustrating how ionizer 30 is used in conjunction with deep V-pack filter assembly 31. It should be noted however, that ionizer assembly 30 is mounted to or fits on to, by means of aligning channel guides, either of the above filter embodiments in the same manner in order to create a working electrically enhanced filter configuration. Hence, the ionizer 30 is also applicable to the non-pleated or folded filter embodiment.

Figure 7:
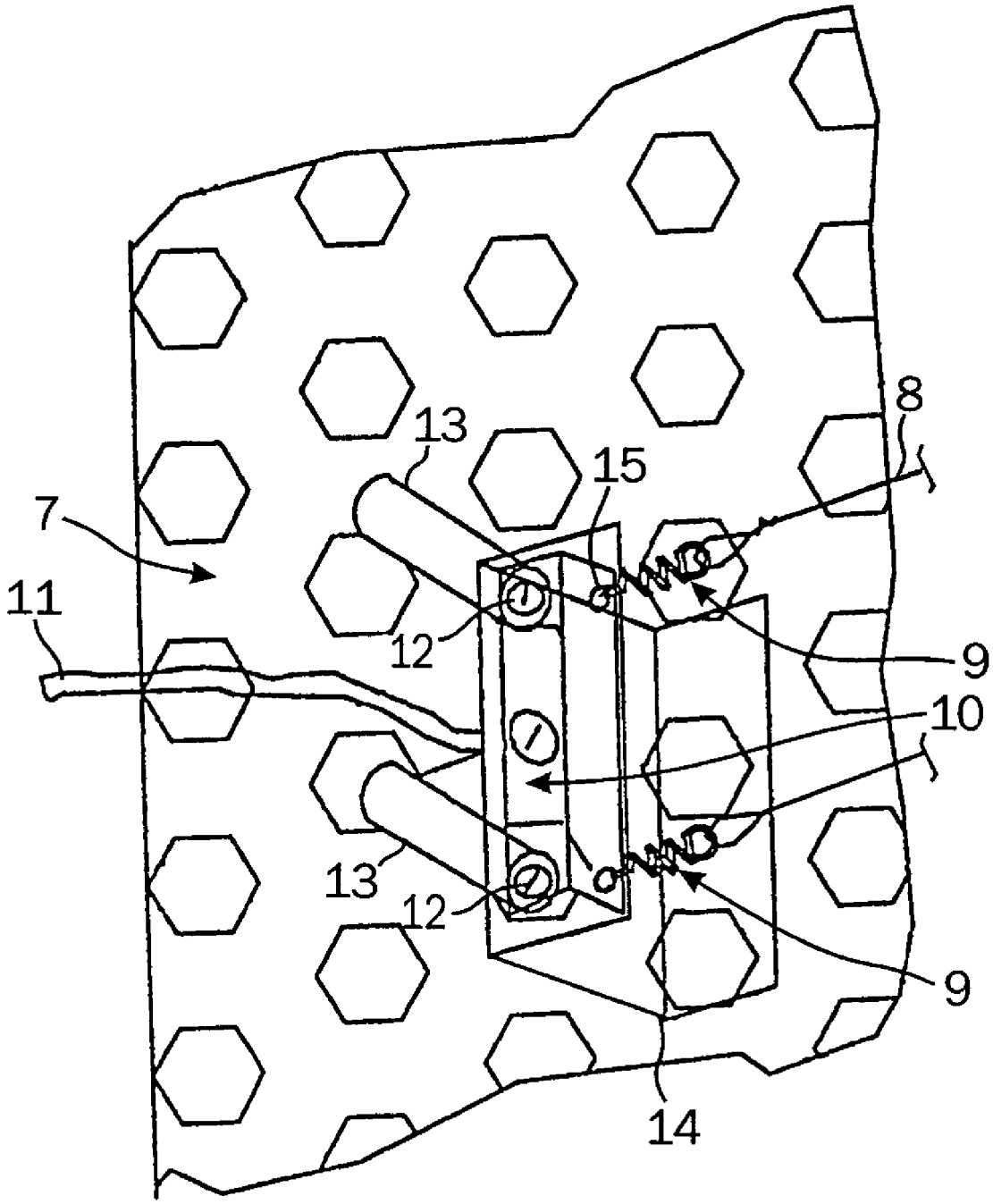
FIG. 7 shows the details of an ionizing electrode mounted with a control ground electrode in an embodiment constructed according to the principles of the present invention.

The ionizer assembly 30 shown in the enlarged view in FIG. 7 is constructed with a perforated metal plate 7, with or without the pre-filter channel 25 or other mechanism used to hold a prefilter 45 at the upstream face of the ionizer. Onto this plate 7 high voltage electrodes 8, typically made of Tungsten are mounted at a separation of distance d, from the perforated metal plate. Electrodes 8 are mounted as single wires or in pairs or sets of wires, spaced between about 0.75" to 2" apart, depending on the opening within each of the V-packs or flat filter folds, onto a bus bar 10 which is in turn is mounted on top of dielectric and non-electrically conductive standoff or standoffs 13 made of non-electrically conducting material such as a ceramic. Stand-offs 13 typically are threaded on the inside at both ends so as to enable mounting via screws 12 on to a small non perforated section of the generally-perforated metal plate (control ground electrode) 7 on one end, and the conductive metal bus bar 10 on the other end of each standoff 13. Wire electrodes 8 are then attached typically via springs 9 to holes 15 by using loops on the spring, to bus bars 10 and extended towards a similar opposing bus bar and spring assembly across the control ground electrode 7, so that the wires can be installed typically within the V opening. Alternately the bus bar may have one or more needle or sharp points on it to serve as ionization points. High voltage is applied to bus bar 10 and thence to electrodes 8 via high voltage cable 11 which is typically connected to a high DC voltage power supply via quick connect high voltage couplers. In order to eliminate any potential arcing from any rough metal surface of the ionizer's 30 bus bar 10, springs 9 or wire or spring loops, a dielectric non-electrically conductive C-shaped, channel shield 14 may be used to shield these components from other surfaces as shown in the enlargement of FIG. 6 presented by FIG. 7. Alternatively, instead of a C-channel, a flat dielectric plate covering the top of the entirety bus bar 10 and spring assembly may be used. Typically, non-electrically conducting materials such as acrylic or appropriate nylon or polycarbonate, which have appropriate dielectric properties, may be used to form shield 14.

Referring now to FIG. 15 and FIG. 19, ionizer assembly 30 may be attached to filter assembly 31 using fasteners such as threaded bolts or screws 23 which fit into metal guide tabs 21 attached to the exterior of filter housing 24. A wing nut 22 or other removably receptive fastener may be used to secure bolts 23. Tabs 21 enable one or sets or pairs of ionizer electrodes 8 to be correctly spaced within each V-shaped pair of pleats of filter assembly 31, while maintaining correct values of $d_2$ (cf Table II). The maintenance of proper values of $d_2$ for each of ionizing electrodes 8 and charge transfer electrodes 5 is important to assure the safe and efficient operation of the deep electrically enhanced filter. Alternatively, the ionizer assembly 30 may be constructed with angle guides so that it can be pushed against filter assembly 31 only in one way so as to maintain the above gap $d_2$ between the wires 8 and the CTE 5. The ionizer assembly 30 and the filter 31 are held and maintained in this position by means of bolts or other means that push both assemblies against the seal plate 34, such that the gasket 26 on filter assembly 31 is compressed against the seal plate 34.

Figure 18:
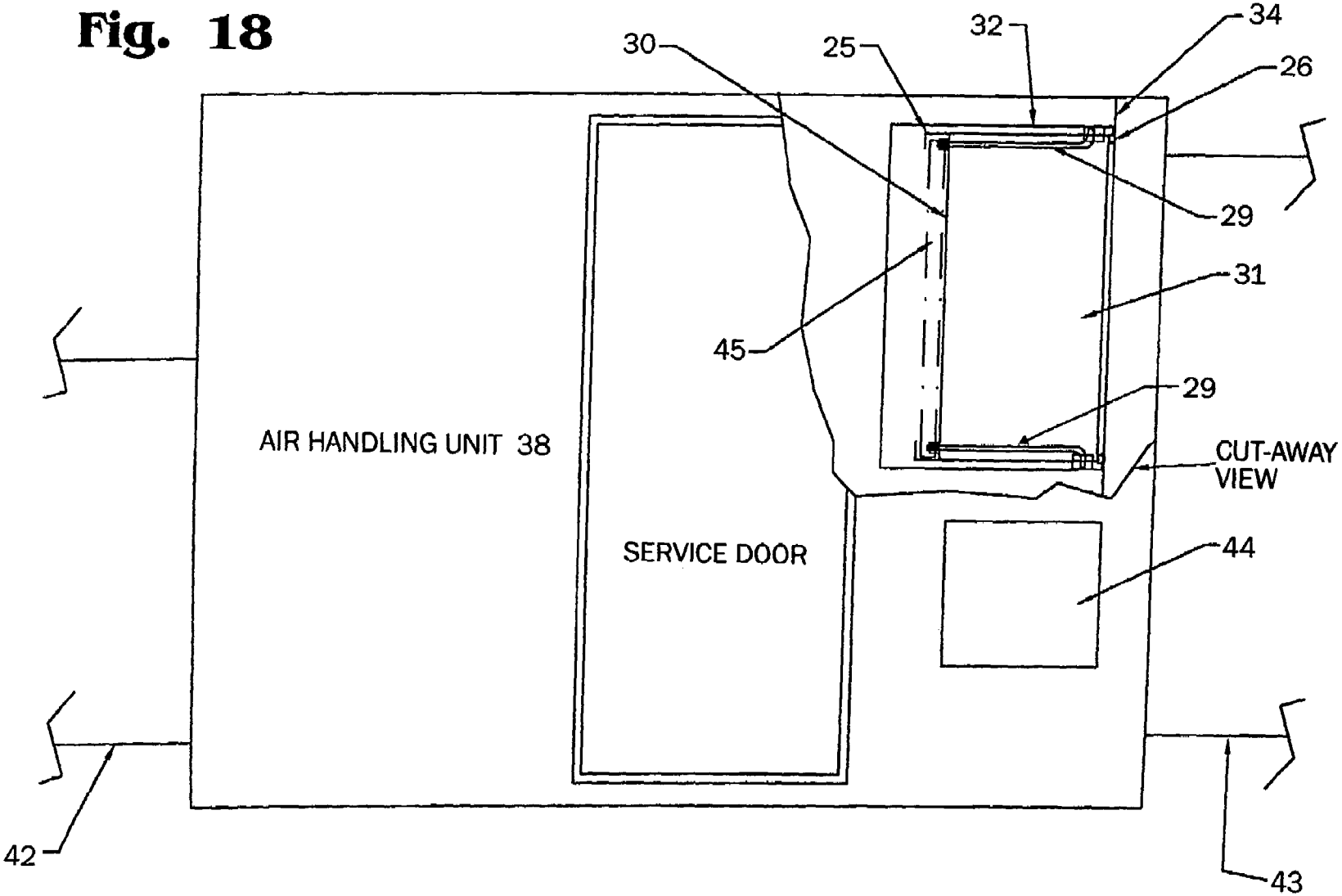
FIG. 18 is an elevation, cross-sectional view illustrating an assembly that can be used to mount single or multiples of filter elements and ionizers in air handling units.

FIG. 18 shows a housing that can be used to mount single or multiples of such filters and ionizers in air handling units 38. A filter frame assembly 32, which is sealed against a seal plate 34 in air handling unit 38 either by welding or other means such as by using polymeric seal materials. Frame assembly 32 has at least four members 29 mounted on at least 2 opposite sides; members 29 are installed into brackets with holes onto which a L-shaped rods or members 29 with threaded bolt on the end are inserted. At the threaded end is a L-shaped washer with a nut that threads on to the L-shaped rod. This and other such filter sealing assemblies are available from companies such as Camfil-Farr and AirGaurd among many others, and hence this mechanism need not be drawn in detail or described further here.

Filter assembly 31 and ionizer assembly 30 are first assembled together and then inserted into frame 32, as an united assembly, and then the nuts and L washers or clips on sealing member 29 are tightened to be pulled over the edge of ionizer control electrode 7, which pulls the entire assembly together, thereby compressing gasket 26 against sealing surface 34.

In the assembly shown by FIG. 18, it is not possible to use metal guide tabs 21, as shown in FIG. 15, because there is typically no room for guide tabs 21 on the side of filter frame assembly 32. In this case, ionizer assembly 30 is accurately guided into filter assembly 31 by a set of two or four channel guide members 33 attached to the ionizer assembly 31. Guides 33 fit snugly over the filter assembly thus properly positioning the ionizing assembly 30 within the filter assembly 31. Sealing member 29 then holds assemblies 30 and 31 together.

FIGS. 18 and 19 show housing 38 along with the connections of air inlet 42 and outlet duct 43. Housing 38 may contain a fan 35, cooling and heating coils (not shown) and the filtration system of ionizer 30 and filter assembly 31. FIG. 19 also shows electrical box 44, which is mounted on the outside of air handler housing 38. This box contains the high voltage power supplies, indicator lights, switches and controls that enable control the filtration system. Housing 38 also has a service door, which is typically a walk-in or side access door to change the multiple number of filters. For single filters, the service door is located so that the filter seal member 29 and the threaded fasteners are easily accessible from the outside.

FIG. 19 shows an isometric view of a typical housing 44 that is separate from the air handling housing 38, that can be used within a duct system that is connected to air handling unit housing 38. The typical housing 44, often referred to as an in-duct filter housing, uses of an optional fan 35 to draw the air through the enhanced filter system, electrical component compartment 37, seal plate 34 and service door 36. The controls and indicators 46, are mounted on the outer surface of electrical compartment 37. A grounding clip 47 of an electrically conducting material such as metal, or with the alternative self-fastening structure of clip 47' bearing deformable retainers 47*a* shown in FIG. 19A, forms an electrical path of conduction between downstream ground electrode 4 via end cap 2, and the electrically conducting frame of filter assembly 31. The frame of filter assembly 31 serves as a local reference potential such as ground, and may be electrically coupled to a ground potential, such as earth, with a grounding strap (not shown). Optionally if the filter frame is non-conductive a separate ground clip, typically with multiple U members that straddle each apex of the V-pack to make ground contact with each set of ground electrodes 4, may be used. In this case the ground clip is designed to fit on to the filter V-pack apexes in a manner that it also makes contact with the filter housing. Ionizer 30 and filter 31 assemblies are also shown without detail. Either filter assembly 31*a* or 31*b*, or another filter assembly, may be used as filter assembly 31. It should be noted that the ionizer control electrode 7 may be formed in a manner such that two U-shaped channels are formed which enable a prefilter to slide into the U-shaped channels. This serves as a convenient prefilter holding assembly. This simple configuration is not shown in detail here. Alternatively, a conventional prefilter frame that attaches to a conventional filter frame may be used as described above for the case of the air handling unit application. If fan 35 is not required in the construction of a particular embodiment, a flow switch or contact provided form an air handler fan may be used so that when there is no airflow, then the high voltage power supply to the ionizer wires is shut down. Service door 36 is positioned so that when door 36 is open, a safety disconnect switch is opened so that all power to the filter unit is disconnected.

Either the upstream side or the downstream side of the filter depending on which side the filter is sealed against seal plate 34, has a polymeric (typically closed cell polyurethane foam or rubber) gasket 26 with sufficient hardness for sealing assembly 31 against seal plate 34. Filter assembly 31 is then sealed against seal plate 34 by either applying external force against ionizer assembly 30 by incorporating a bracket 48, which is threaded to move a bolt 49 with knob attached as is shown by FIG. 19, or by tightening nuts or wing nuts 22 onto bolts that are attached to the seal plate. Alternately, the bolts may be moved through nuts mounted on the intake side of the filter housing (around the fan) so as to move against the ionizer-filter assembly. These bolts can also go through the metal guide tabs 21 that are welded on to filter assembly 30. Alternatively, placement of sealing member 29 onto filter frame 32, enables attachment of springs that pull filter assembly 31 onto the seal plate as shown by FIG. 18. Only the bolt 49 sealing configuration is shown in FIG. 19. Filter assembly 31 can also be sealed against seal plate 34 by a variety of other common and conventional sealing mechanisms, such as adding a knife edge to filter assembly 31 or seal plate 34, which seals up against a gel embedded all around seal plate 34 or filter assembly 31. The sealing mechanism is not shown in detail in FIG. 19.

Figure 20:
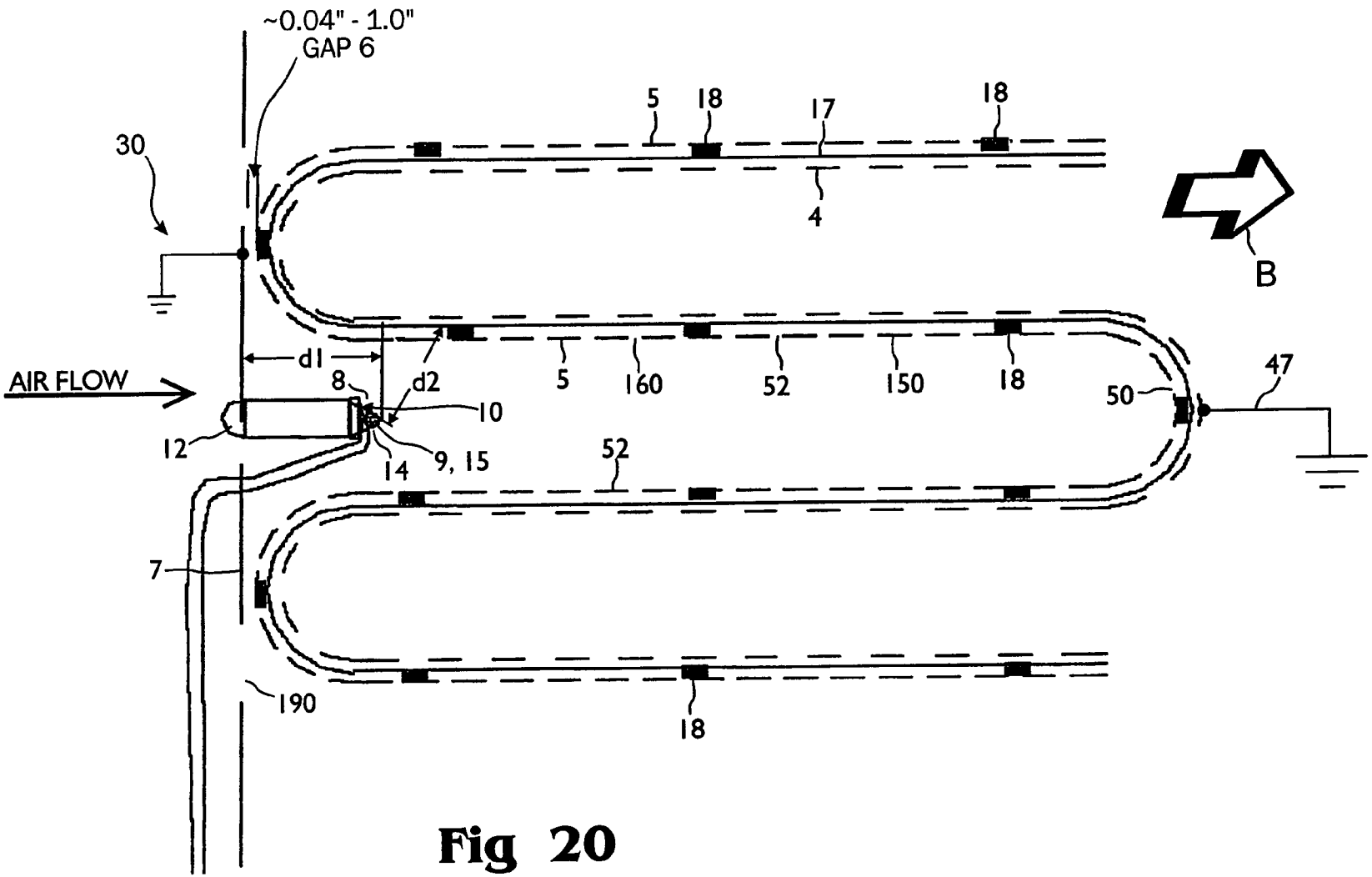
FIG. 20 is a diametric view of an alternative configuration of an embodiment constructed according to the principles of the present invention with parallel pleats and curved apexes.

FIG. 20 illustrates the construction of an alternative embodiment with at least one of the pockets in the filter assembly 31 formed by a pair of folds 52 line in substantially, approximate parallel planes joined at the downstream, closed and by a curved, or C-shaped, apex 50, rather than a V-shaped apex. The ionizing assembly 30 maybe constructed with a single electrode 8, rather than an array formed by a plurality of electrodes 8, spaced approximately equidistantly between the upstream surfaces of CTE 5 of each pleat 52. Insulated spacers 18, or glued beads, may be used to electrically separate CTE 5 from the unfolded, thinner medium 17 if necessary for collection filed stabilization.

Figure 21:
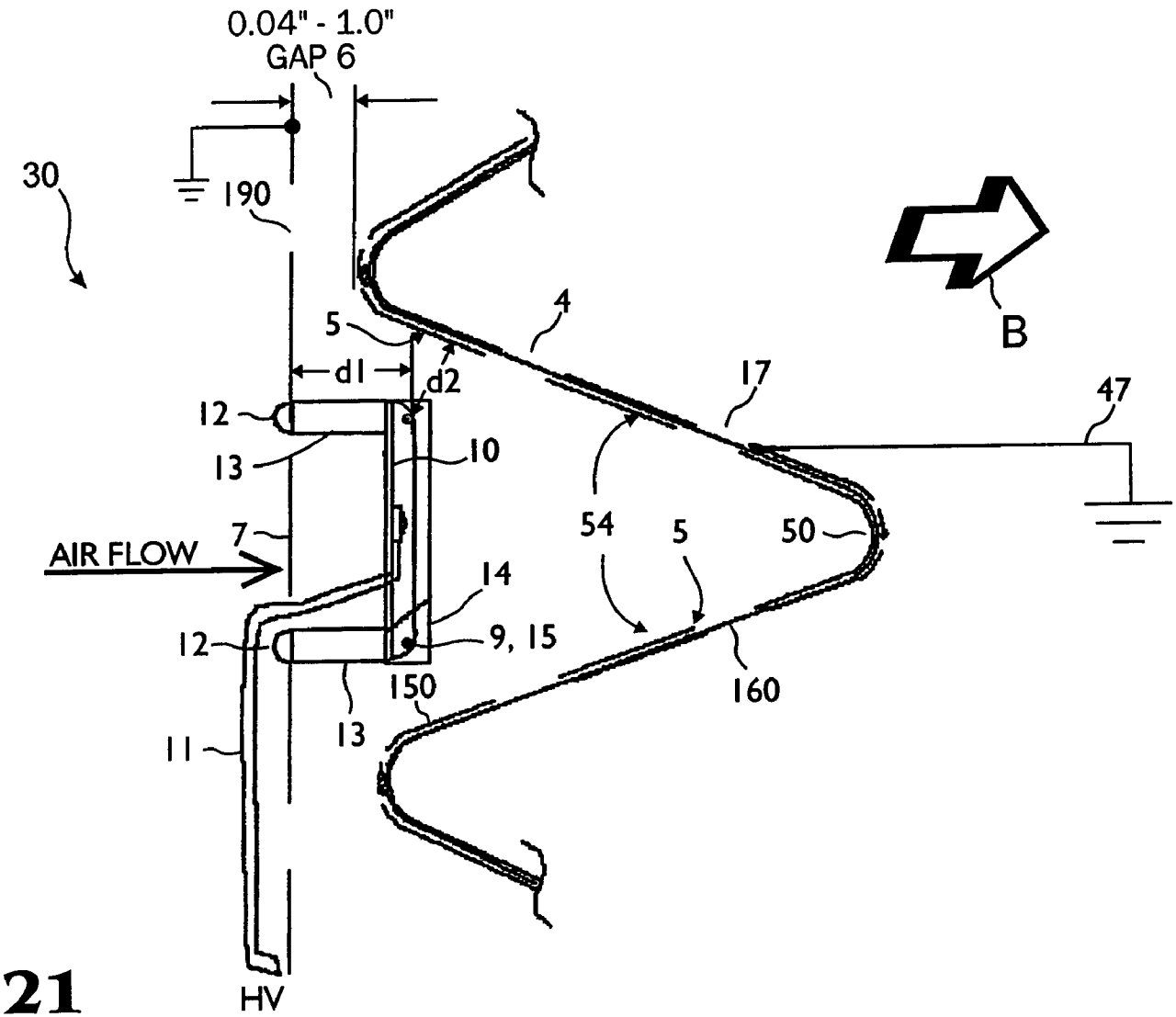
FIG. 21 is a diametric view of an alternative configuration of an embodiment constructed according to the principles of the present invention, with curved apexes.

FIG. 21 illustrates the construction of an alternative embodiment with potentially intersecting arms 54 joined at a curve, or C-shaped apex 50. Ionizing assembly 30 may be constructed with multiples of either a single or a pair depending on the opening of the filter folds, of ionizing electrodes 8, each separated by a least distance $d_2$ from the closest surface of CTE 5.

The foregoing paragraphs describe the details of a method and apparatus that uses deep filters as an efficient and safe electrically enhanced filter (EEF) in order to obtain ultra low pressure drop, high efficiency of particulate removal and high dirt holding capacity and life of the filter. The EEF is constructed with a housing (with or without an internal air moving device such as a fan), and a deeply pleated filter preferably a V-pack filter with sets of downstream ground electrodes 4 and charge transfer electrodes 5 borne by the opposite, major parallel outer surfaces of filter medium 1, 16, 17 assembled in a filter pack within as a unified filter element. Seal plate 34 seals against the gasket on the filter element to prevent blow-by of air; ionizer assembly 30 ionizes the gas and charges particles entering between the deep pleats of the filter element and also transfers a charge to the charge transfer electrodes 5 on the filter pack. A high electrical potential is applied to electrodes 8 or other charging elements in the ionizer. Charge transfer electrodes 5 enable the device to function with a high particle collection field between charge transfer electrodes 5 and downstream grounded electrodes 4 that enables higher entrapment of the particles on the deep filter medium, in a safe and efficient manner. In effect, the use of the charge transfer electrodes (CTEs) 5 allow the deeply pleated filter to function as an effective filter while avoiding the inherent inability of contemporary designs for filters to accommodate a greater depth of the filter element.

Ionizer assembly 30 has a ground control electrode 7 and high voltage electrodes 8 with appropriate shielding. This configuration stabilizes the corona and minimizes the possibility of field cancellation or back corona discharge as a result of coating of counter electrode 7 with highly resistive dust. The high field strength between ground control electrode 7 and the high voltage applied to electrodes 8 results in corona charging of incoming airborne particles. In the practice of this invention, the distances between the ground control electrode 7 and electrodes 8, and the spacing between electrodes and the CTEs 5 determine the surface potential developed on CTE 5 and hence the collection field between CTEs 5 and the downstream ground electrodes 4. In alternative embodiments, control ground electrode (CGE) 7 and downstream ground electrode (DGE) 4 may be at either a negative or at a lower potential with respect to the applied potential, and do not need to be rather strictly at ground potential.

Additionally, although contemporary devices accumulate dust in patterns that can sometimes generate undesired back corona discharge, embodiments constructed according to the principles of the present invention require that the dust would have to travel against the direction of the air flow in order to accumulate on ground plate 7; this minimizes the risk of back corona discharge that has plagued contemporary filters due to accumulations of dust.

In the typical practice of my inventions, referring, by way of example, to the embodiment illustrated by FIG. 6, filter medium 16 may be pleated into a plurality of successive pleats, with a pleat depth being between approximately 0.25" to approximately 6" inches in depth. Charge transfer electrode 5 may rest upon these pleats, and the shortest distance, $d_2$ between CTE 5 and the closest one of ionizing electrodes 8, is on the order of between approximately 0.25" to approximately 2". Ground control electrode 7 should be spaced-apart from ionizing electrodes 8 by approximately 0.25" to approximately 1.5". The voltage applied to ionizing electrodes 8 is between approximately 3 to approximately 18 kilo-Volts.

Although several of the embodiments are illustrated with ionizing electrodes 8 in the form of straight, electrically conducting wires, other embodiments maybe constructed with sharp, distally extending objects such as needles or points.

The foregoing discussion describes the details of a method and apparatus using deeply pleated filters to provide efficient and safe electrically enhanced filtering (EEF), with ultra low pressure drop, higher efficiency of particulate removal and higher dirt holding capacity over the life of the filter. An EEF may be constructed with a housing, with or without an internal air moving device such as a fan, a deeply pleated filter, preferably a V-pack filter with sets of downstream ground electrodes and charge transfer electrodes borne by the exterior surface of the filter packs that form the filtering element. An ionizer assembly that ionizes the gas and charges particles entering the deeply pleated filter and also transfers a charge to the charge transfer electrodes on the filter pack. A plate seals against the gasket on the filtering element. A high electrical potential is applied to charging elements in the ionizer. The charge transfer electrodes enable the device to function with a high particle collection field between the charge transfer electrodes and the downstream grounded electrodes, irrespective of filter depth, to safely and efficiently attain higher entrapment of the particles on the filter medium.

As described in the foregoing description, the details of an electrically enhanced filtering apparatus, and a process for constructing that apparatus, contemplate a layer of a porous filter medium exhibiting a thickness, folded into arms forming one or more pockets with an apex of the pocket located on a downstream side of the medium and with a base of the pocket open to an upstream side of the apparatus. A first electrically conducting, perforated grid may be disposed over a first major exterior of the medium to cover the downstream side of each of the arms, a second electrically conducting, perforated grid electrically separated from the first grid by the thickness of the medium, may be disposed across a second major exterior of each of the arms on an upstream side of the medium, and a control electrode, which may be maintained at a local reference potential such as ground, is spaced-apart upstream from the second electrically conducting grid. An ionizing electrode may be interposed between and separated from the control electrode and the second electrically conducting grid, on the upstream side of the medium, with the ionizing electrode spaced-apart from opposite corresponding arms of the medium while extending along the length of the pocket, parallel to and spaced-apart from the second grid.

A typical conventional V-pack filter with this pleated V pack construction could exhibit a filter efficiency of 99.99% with a particle size of 0.3 micrometers, and provide a pressure drop of about one inch water column at a filter face flow velocity of 600 feet per minute. Another conventional grade of a V-pack filter with a filtration efficiency of 95% at 0.3 micrometers particle size, and has a pressure drop one-half of an inch water column (i.e., 0.5" WC) at a filter face air flow velocity of 600 feet per minute. I have found that if such a 95% filter could be enhanced in a safe electrical manner to provide approximately 99.97 to 99.99% filtration efficiency at 0.3 micrometer particle size (commonly referred to as HEPA filtration efficiency), then an ultra low pressure drop HEPA filter could be achieved with significant savings in operational costs than are available with conventional HEPA filters. Similarly, lower grade, deep V-pack or other forms of deep filter material could be safely electrically enhanced to produce higher efficiency filters having significantly lower pressure drops. The operating cost savings would be in terms of fan power required and the longevity of the filter, improvements that result in savings in terms of energy, downtime, labor and material costs related to filter replacement and maintenance. The consequential benefits in industrial applications (cf. Jaisinghani, "Energy Efficient Cleanroom Design", 2000) could be as high as 60% savings in energy consumption related to air moving. Currently, commercial buildings in the U.S. annually consume about 0.75 quads of energy attributed to the cost of moving air. If other industrial applications are included, the electrical energy consumed by fans in heating, ventilating and air conditioning applications are probably about twice this number. Embodiments of this invention would provide a significant reduction in the overall industrial energy consumption required for air moving and heating, ventilating and air conditioning (i.e., HVAC) costs, this provides significant reductions in greenhouse gases and other pollutants associated with energy production. The estimated annual U.S. potential for savings in atmospheric carbon is about $9.7154\times10^6$ metric tons of carbon.

What I claim is:

1. An electrically enhanced filtering apparatus, comprising:

a layer of a porous filter medium folded into arms forming one or more pockets exhibiting a downstream side of said medium and with a base of said pocket open to an upstream side of said apparatus;

a first electrically conducting, perforated grid disposed over a first major exterior of said medium to cover said downstream side of each of said arms;

a second electrically conducting, perforated grid electrically separated from said first grid by said medium, disposed across a second major exterior of each of said arms on an upstream side of said medium; and one or more electrodes separated from said upstream side of said medium, with said one or more electrodes spaced-apart from opposite corresponding ones of said arms while extending into at least one of said pockets and spaced-apart from said second grid.

2. The apparatus of claim 1, further comprised of said base exhibiting a linear dimension greater than a thickness of said medium.

3. The apparatus of claim 1, further comprised of a distance between said base and an apex formed between neighboring said arms being greater than or equal to a linear dimension exhibited by said base.

4. The apparatus of claim 1, further comprised of a distance between said base and said apex being not less than a linear dimension exhibited by said base, and said linear dimension being greater than a thickness of said medium.

5. The apparatus of claim 1, further comprised of:

an air inlet; and an electrically conducting screen spaced-apart from said electrode and separated by said electrode from said second grid, extending across said air inlet.

6. The apparatus of claim 1, with said layer further comprised of:

said layer disposed in a plurality of pleats within each of said arms, with said pleats undulating between said first grid and said second grid.

7. The apparatus of claim 1, further comprised of:

said layer extending along each of said arms in an elongate linear continuum lying between said first grid and said second grid.

8. The apparatus of claim 6, further comprised of said layer extending along each of said arms in a linear continuum lying between said first grid and said second grid.

9. The apparatus of claim 1, further comprised of:

said layer extending along each of said arms in a linear continuum lying between said first grid and said second grid; and an electrical insulator maintaining said second grid physically spaced-apart from said medium.

10. The apparatus of claim 1, further comprised of:

said arms being joined at an apex to form a V-shape.

11. The apparatus of claim 1, further comprised of:

said arms being substantially parallel and being connected at opposite ends to different neighboring arms.

12. The apparatus of claim 1, further comprised of:

said second grid being borne by said upstream surface and lying upon said arms.

13. The apparatus of claim 6, further comprised of:

said second grid being borne by said upstream surface and lying upon said pleats.

14. The apparatus of claim 1, further comprised of:

an electrical insulator maintaining said second grid spaced apart from said upstream surface.

15. The apparatus of claim 1, further comprised of:

said second grid comprising a material porous to passage of gaseous fluid through said apparatus but partially impervious to particles borne by the gaseous fluid.

16. The apparatus of claim 1, further comprised of:

said second grid comprising a material porous to passage of gaseous fluid passing through said apparatus but partially impervious to particles borne by the gaseous fluid; and said second grid being relatively more electrically conductive than said medium.

17. The apparatus of claim 1, further comprised of;

said second grid comprising a material porous to passage of gaseous fluid passing through said apparatus but partially impervious to particles borne by the gaseous fluid; and said second grid being made of a material selected from a group comprising carbon, carbon fibers, fibers coated with carbon, and combinations thereof.

18. The apparatus of claim 1, further comprising at least one of said first grid and said second grid being made of a material selected from a group comprised of carbon, carbon fibers, fibers coated with carbon, and combinations thereof.

19. The apparatus of claim 1, further comprising:

a first electrical conductor coupling said first grid to a local reference potential;

a second electrical conductor disposed to couple said electrode to a second and substantially different potential, and thereby enabling said second grid to exhibit a first potential difference relative to said electrode, and a second potential difference relative to said first grid.

20. The apparatus of claim 1, further comprising:

a first electrical conductor coupling said first grid to a local reference potential;

a second electrical conductor disposed to couple said electrode to a second and substantially different potential.

21. The apparatus of claim 1, further comprising:

an inlet accommodating entry of gaseous fluid into said apparatus; and an electrically conducting screen spaced-apart upstream from said electrode and spaced-apart from said second grid, extending across said inlet and accommodating a potential difference between said electrically conducting screen and said electrode that creates significant ionization of the gaseous fluid.

22. The apparatus of claim 1, further comprising:

a first electrical conductor coupling said first grid to a local reference potential;

a second electrical conductor disposed to couple said electrode to a second and substantially different potential; and said apparatus exhibiting a first potential difference between said electrode and said first grid.

23. The apparatus of claim 1, further comprising:

a first electrical conductor coupling said first grid to a local reference potential;

a second electrical conductor disposed to couple said electrode to a second and substantially different potential, thereby enabling said second grid to exhibit a first potential difference relative to said electrode and a second potential difference relative to said first grid;

said apparatus exhibiting a third potential difference between said electrode and said first grid; and an electrically conducting screen spaced-apart from said electrode and separated by said electrode from said second grid, extending across said inlet and establishing a third potential difference between said electrically conducting screen and said electrode.

24. The apparatus of claim 1, further comprising:

a first electrical conductor coupling said first grid and to a local reference potential;

a second electrical conductor disposed to couple said electrode to a second and substantially different potential;

said apparatus exhibiting a first potential difference between said electrode and said first grid;

an inlet accommodating egress of gaseous fluid into said apparatus; and an electrically conducting screen spaced-apart from said electrode and spaced-apart from said second grid, extending across said inlet and establishing a third potential difference between said electrically conducting screen and said electrode that creates significant ionization of the gaseous fluid.

25. An electrically enhanced filtering process, comprising:

positioning across a flow of transient gaseous phase fluid, a porous filter medium and folded into one or more arms forming at least one pocket with each pocket closed at an apex on a downstream side of said arms and with a base of each pocket opening upstream sides of said arms to incidence of said flow;

maintaining a first electrically conductive grid disposed along said downstream sides of said arms able to accommodate passage of the fluid from said medium;

maintaining a second electrically conductive grid covering said upstream sides of said arms in a position spaced-apart from said first grid to accommodate said passage of the fluid, at a potential difference relative to said first grid; and locating one or more electrodes within said pocket at a location within the flow of the fluid, spaced-apart from said second grid, and disposed to transfer a charge onto said second grid.

26. The process of claim 25, further comprised of:

coupling said first grid to a reference potential; and establishing said potential difference between said second grid and said first grid by applying to said electrode a potential difference relative to said reference potential.

27. The process of claim 25, further comprised of:

enabling occurrence of ionization of the fluid by a potential difference between said electrodes and maintaining a potential difference between said electrodes and a control electrode spaced-apart and upstream from said first electrode and spaced-apart and upstream from said second grid, within the flow of the fluid.

28. The process of claim 25, further comprised of arranging said medium along each of said arms with a plurality of folds undulating alternately toward said first grid and said second grid.

29. The process of claim 25, further comprised of arranging said medium along each of said arms in a linear continuum positioned between said first grid and said second grid.

30. The process of claim 25, further comprised of:

extending said medium as a layer along each of said arms in an elongate linear continuum positioned between said first grid and said second grid; and electrically isolating said second grid from direct electrical continuity with said medium.

31. A filter for an electrically enhanced filtering apparatus, comprising:

a layer of a porous filter medium folded into one or more arms forming a pocket with a terminus of said pocket located on a downstream side of said medium and with a base of said pocket open to an upstream side of said apparatus;

a first electrically conducting grid disposed on an exterior of said medium to cover said downstream side of each of said arms and form an electrical connection with a common electrical conductor of said apparatus; and a second electrically conducting grid electrically separated from said first grid by at least said medium, disposed across the exterior of each of said arms within said pocket on an upstream side of said medium spaced-apart from other electrical conductors of said apparatus.

32. The apparatus of claim 31, further comprised of said base exhibiting a linear dimension greater than a cross-sectional thickness of said filter medium.

33. The apparatus of claim 31, further comprised of a distance between said base and said terminus being greater than or equal to a linear dimension exhibited by said base.

34. The apparatus of claim 31, further comprised of a distance between said base and said terminus being not less than a linear dimension exhibited by said base, and said linear dimension being greater than a thickness exhibited by said medium.

35. The apparatus of claim 31, further comprised of:

an air inlet and an electrode spaced-apart from said second grid, positioned between said arms to extend across said air inlet.

36. The apparatus of claim 31, with said layer further comprised of:

said layer disposed in a plurality of pleats within each of said arms, with said pleats undulating between said first grid and said second grid.

37. The apparatus of claim 31, further comprised of:

said layer extending along each of said arms in a linear continuum lying between said first grid and said second grid.

38. The apparatus of claim 31, further comprised of said layer extending along each of said arms in an elongate linear continuum lying between said first grid and said second grid.

39. The apparatus of claim 31, further comprised of:

said layer extending along each of said arms in a linear continuum lying between said first grid and said second grid; and an electrical insulator maintaining one of said first grid or said second grid physically spaced-apart from said medium.

40. The apparatus of claim 31, further comprised of said arms being joined at said terminus to form a V-shape.

41. The apparatus of claim 31, further comprised of said arms being substantially parallel and being joined at alternate ends to different ones of said folds.

42. The apparatus of claim 31, further comprised of said second grid being borne by said upstream surface and lying upon said arms.

43. The apparatus of claim 36, further comprised of said second grid being borne by said upstream surface and lying upon said pleats.

44. The apparatus of claim 31, further comprised of an electrical insulator maintaining said second grid spaced apart from said upstream side.

45. The apparatus of claim 31, further comprised of said second grid comprising a material porous to passage of gaseous fluid through said apparatus but partially impervious to particles borne by the gaseous fluid.

46. The apparatus of claim 31, further comprised of:

said second grid comprising a material porous to passage of gaseous fluid passing through said apparatus but partially impervious to particles borne by the gaseous fluid; and said second grid being relatively more electrically conductive than said medium.

47. The apparatus of claim 31, further comprised of;

said second grid comprising a material porous to passage of gaseous fluid passing through said apparatus but partially impervious to particles borne by the gaseous fluid; and said second grid being made of an electrically conductive material selected from a group comprising carbon, carbon fibers, fibers coated with carbon, and combinations thereof.

48. The apparatus of claim 31, further comprising at least one of said first grid and said second grid being made of a material selected from a group comprised of carbon, carbon fibers, fibers coated with carbon, and combinations thereof.

49. A filter for an electrically enhanced filtering apparatus, comprising:

a layer of a porous filter mediumdisposed in a plurality of pleats within each of one or more of a plurality of arms, with said pleats undulating in succession, folded into said one or more arms forming a pocket with a terminus of said pocket located on a downstream side of said medium and with a base of said pocket open to an upstream side of said apparatus;

an electrical conductor comprising a first electrically conducting grid disposed to cover pleats along said downstream side of each of said arms; and a second electrically conducting grid electrically separated from said first grid by said medium, disposed to extend across pleats along a second exterior of each of said arms on an upstream side of said medium and remain spaced-apart from other electrical conductors of said filter and said apparatus.

50. The apparatus of claim 49, further comprised of said base exhibiting a linear dimension greater than a thickness created by said pleats.

51. The apparatus of claim 49, further comprised of a distance between said base and said terminus being greater than or equal to a linear dimension exhibited by said base.

52. The apparatus of claim 49, further comprised of a distance between said base and said terminus being not less than a linear dimension exhibited by said base, and said linear dimension being greater than a thickness of said medium created by said pleats.

53. An electrically enhanced filtering apparatus, comprising:

a layer of a porous filter medium, folded into one or more arms forming a pocket with a terminus of said pocket located on a downstream side of said medium and with a base of said pocket open to an upstream side of said apparatus;

a first electrically conducting, perforated grid disposed on an exterior of said medium to cover said downstream side of each of said arms;

a second electrically conducting, perforated grid electrically separated from said first grid by said medium, disposed across the exterior of each of said arms on an upstream side of said medium;

an electrode separated from said upstream side of said medium, with said electrode spaced-apart from opposite corresponding ones of said arms while extending through said pocket parallel to and spaced-apart from said second grid; and an electrical conductor spaced apart upstream from said electrode and said second electrically conducting grid, disposed to be maintained at a potential difference relative to said electrode.

54. The apparatus of claim 53, further comprised of said base exhibiting a linear dimension greater than a thickness of said medium.

55. The apparatus of claim 53, further comprised of a distance between said base and said terminus being greater than or equal to a linear dimension exhibited by said base.

56. The apparatus of claim 53, further comprised of a distance between said base and said terminus being not less than a linear dimension exhibited by said base, and said linear dimension being greater than said thickness.

57. An electrically enhanced filtering apparatus, comprising:

a layer of a porous filter medium disposed in a plurality of pleats undulating in succession and folded into one or more arms forming a pocket with a terminus of said pocket located on a downstream side of said medium and with a base of said pocket open to an upstream side of said apparatus;

a first electrically conducting grid disposed on an exterior of said medium to cover said downstream side of each of said arms;

a second electrically conducting grid separated from said first grid by said medium, disposed across the exterior of each of said arms on an upstream side of said medium;

at least one electrode separated from said upstream side of said medium, with said electrode spaced-apart by a fixed distance from opposite corresponding ones of said arms while extending through said pocket parallel to and spaced-apart from said second grid; and an electrically conducting screen spaced apart upstream from said electrode and said second electrically conducting grid, disposed to be maintained at a reference potential difference relative to said first electrode.

58. The apparatus of claim 57, further comprised of said base exhibiting a linear dimension greater than a thickness created by said pleats.

59. The apparatus of claim 57, further comprised of a distance between said base and said terminus being greater than or equal to a linear dimension exhibited by said base.

60. The apparatus of claim 57, further comprised of a distance between said base and said terminus being not less than a linear dimension exhibited by said base, and said linear dimension being greater than a thickness of said medium.

61. An electrically enhanced filtering process, comprising:

positioning across a flow of transient gaseous phase fluid, a porous filter medium folded into one or more arms forming at least one pocket with a closed terminus on a downstream side of said medium and with a base of each said pocket opening upstream sides of said arms to incidence of said flow;

maintaining a first electrically conductive grid disposed along said downstream side of said medium able to accommodate passage of the fluid through said medium;

maintaining a second electrically conductive grid covering said upstream sides of said arms in a position spaced-apart from said first grid to accommodate said passage of the fluid, electrically separated from said first grid by said medium;

maintaining a first potential difference between said second grid and said first grid by locating at least one electrode within said pocket at a location within the flow of the fluid, spaced-apart from and parallel to said second grid, and disposed to transfer a charge onto said second grid; and maintaining an electrically conducting screen spaced-apart upstream from said first electrode and said second electrically conductive grid, at a second potential difference relative to said first electrode.

62. The process of claim 61, further comprise of:

coupling said first grid to a reference potential; and establishing said first potential difference between said second grid and said first grid by applying to said electrode a potential difference relative to said reference potential.

63. The process of claim 61, further comprised of:

maintaining a control electrode spaced-apart and upstream from said first electrode, within the flow of the fluid, at a third potential difference relative to said electrode, while a second and lesser potential difference occurs between said electrode and said second grid, and said first potential difference occurs between said second grid and said first grid.

64. The process of claim 61, further comprised of pleating said filter medium in a plurality of said arms into a plurality of pleats undulating between said first grid and said second grid.

65. The process of claim 61, further comprised of arranging said filter medium as a layer extending along a plurality of said arms between said first grid and said second grid.

66. The process of claim 61, further comprised of inserting electrical insulators between said filter medium and said second grid.

67. An electrically enhanced filtering process, comprising:

arranging a layer of a filter medium, into at least two folds to define a terminus between each pair of said folds on a downstream side of said layer when said layer is positioned across a flow of a gaseous phase fluid, and an open base on an upstream side of said layer opposite from each corresponding apex;

disposing a first perforated, electrically conducting grid along exposed major surfaces of said folds on said downstream side of said layer; and positioning a second perforated, electrically conducting grid along exposed major surfaces of said upstream side of said layer, spaced-apart by said medium from said first grid and from other electrical conductors.

68. The process of claim 67, further comprised of arranging said layer with a distance between each corresponding base and terminus formed between each pair of said transversely oblique folds being not less than a linear dimension exhibited by said base, with said linear dimension being greater than a thickness of said medium.

69. The process of claim 67, further comprised of removably attaching said filter medium onto one of said first grid and said second grid.

70. The process of claim 67, further comprised of inserting an assembly formed by said first grid and said filter medium into a frame bearing said second grid in electrical isolation from said frame.

71. The process of claim 67, further comprised of:

forming an assembly of said first grid and said filter medium;

potting ends of said assembly intermediate said upstream side and said downstream side to form a seal to passage of the fluid between said ends and a frame encasing said assembly.

72. An electrically enhanced filtering process, comprising:

arranging into at least two transversely oblique folds, a layer of a filter medium exhibiting first major exterior surfaces on an upstream side of said layer separated by a thickness of said layer from second major exterior surfaces on a downstream side of said layer to accommodate passage of gaseous phase fluids through said medium while trapping particles borne by the fluids;

aligning a first electrically conducting grid with said folds along said second major exterior surfaces; and aligning a second electrically conducting grid maintained spaced-apart by said filter medium from other electrically conducting elements of said process, with said folds disposed along said first major exterior surfaces.

73. The process of claim 72, further comprised of arranging said layer with a distance between each corresponding base and terminus formed between each pair of said transversely oblique folds being not less than a linear dimension exhibited by said base, with said linear dimension being greater than a thickness of said medium.

74. The process of claim 72, further comprised of removably attaching said filter medium onto one of said first grid and said second grid.

75. The process of claim 72, further comprised of inserting an assembly formed by said first grid and said filter medium into a frame with an electrically insulating seal separating said assembly from said frame and restricting passage of the fluid between said assembly and said frame.

76. The process of claim 72, further comprised of:

forming an assembly of said first grid and said filter medium;

potting ends of said assembly intermediate said upstream side and said downstream side with a sealant; and inserting said assembly into a frame with said sealant forming a seal to passage of the fluid between said ends and said frame.

77. An ionizer for charging particles in an electrically enhanced ilter, comprising:

a perforated screen of an electrically conducting material approximately defining a surface disposed across an opening to maintain a local reference potential; an array of a plurality of spaced-apart electrically conducting electrodes extending across said opening with neighboring ones of said electrodes being separated and forming a plurality of gaps accommodating protrusion of alternate folds of a filter medium between said neighboring ones of said electrodes, while said electrodes lie between open bases and closed terminus of pockets formed by the folds while spaced physically apart from corresponding major surfaces of the filter medium; and an electrical insulator maintaining at least one of said electrodes spaced-apart from said surface.

78. The electrically enhanced filter of claim 77, further comprised of a plurality of springs having a first end supported by said insulator and a second end maintaining said at least one of said electrodes under tension.

79. The electrically enhanced filter of claim 77, further comprised of a bus interposed to connect said electrical connector and said at least one of said electrodes.

80. The electrically enhanced filter of claim 77, further comprised of said array comprised of a plurality of said electrodes extending across said surface with a first transverse separation between said electrodes within each pair of said electrodes, and with a second and greater separation between each said pair.

81. The apparatus of claim 77, further comprised of: an electrically conducting screen spaced-apart from said electrode and from said second grid, with said electrode disposed between said screen and said second grid.

82. The apparatus of claim 1, further comprising:

a first electrical conductor coupling said first grid to a local reference potential;

a second electrical conductor disposed to couple said electrode to a second potential exhibiting a substantially different magnitude; and an electrically conducting screen spaced-apart from said electrode and spaced-apart from said second grid, accommodating entry of a gaseous phase fluid into said apparatus, disposed to create significant ionization of the fluid by establishing a potential difference between said screen and said electrode.

83. The apparatus of claim 1, further comprising:

a first electrical conductor coupling said first grid to a local reference potential;

a second electrical conductor disposed to couple said electrode to a second and substantially different potential; and an electrically conducting screen spaced-apart from said electrode and from said second grid, extending across said inlet and establishing a first potential difference between said electrically conducting screen and said electrode, with said apparatus exhibiting a second and lesser potential difference between said electrode and said second grid, and a third potential difference between said second grid and said first grid.

84. The apparatus of claim 1, further comprising:

a first electrical conductor coupling said first grid to provide a local reference potential;

a second electrical conductor disposed to couple said electrode to a second and substantially different potential, and an electrically conducting screen spaced-apart from said electrode and from said second grid, extending across said inlet and establishing a first potential difference between said electrically conducting screen and said electrode, with said apparatus exhibiting a second potential difference between said electrode and said second grid and a third potential difference between said second grid and said first grid.

85. The apparatus of claim 31, further comprised of:

said layer extending along each of said arms in a linear continuum lying between said first grid and said second grid; and an electrical insulator maintaining said second grid physically spaced-apart from said medium.

86. The process of claim 61, further comprised of creating an electrical insulator between said filter medium and said second grid.

87. An electrically enhanced filtering apparatus, comprising:

a layer of a porous filter medium folded into arms forming one or more pockets with a terminus of said pocket located on a downstream side of said medium and with a base of said pocket open to an upstream side of said apparatus;

a first electrically conducting, perforated grid disposed over a first major exterior of said medium to cover said downstream side of each of said arms;

a second electrically conducting, perforated grid electrically separated from said first grid by said medium, disposed across a second major exterior of each of said arms on an upstream side of said medium;

an electrode separated from said upstream side of said medium, with said electrode spaced-apart from opposite corresponding ones of said arms while extending through said pocket parallel to and spaced-apart from said second grid; and an electrically conducting screen extending across an inlet to said apparatus, establishing a first potential difference relative to said electrode, while a second potential difference occurs between said electrode and said second grid, and a third potential difference occurs between said second grid and said first grid.

88. The apparatus of claim 87, comprised of said screen and said first grid being coupled to a local reference potential.

89. An electrically enhanced filter, comprising:

a layer of a porous medium having a major first surface and a major second surface, folded into one or more pairs of arms each joined together at a terminus and defining a pocket included between pairs of said arms;

an electrical conductor comprising a first electrically conducting grid extending across said arms of said first major surface;

a second electrically conducting grid extending across said arms of said second major surface while maintained by said filter spaced-apart from other electrical conductors having an operational association with said filter; and at least one of said first grid and said second grid comprising a print of an electrically conducting material deposited upon a corresponding one of said major first surface and said major second surface.

90. An electrically enhanced filtering apparatus, comprising:

a layer of a porous filter medium, folded into arms forming one or more pockets with a terminus of said pocket located on a downstream side of said medium and with a base of said pocket open to an upstream side of said apparatus;

a first electrically conducting grid coupled to a local reference potential and disposed over a first major exterior of said medium to cover said downstream side of each of said arms;

a second electrically conducting grid electrically separated from said first grid by said medium, disposed across a second major exterior of each of said arms on an upstream side of said medium;

an electrical resistance coupling said second grid to said local reference potential; and an electrode separated from said upstream side of said medium, with said electrode spaced-apart from opposite corresponding ones of said arms while extending through said pocket parallel to and spaced-apart from said second grid.

91. The apparatus of claim 90, comprising an electrically conducting screen extending across an inlet to said apparatus, establishing a first potential difference relative to said electrode, while a second potential difference occurs between said electrode and said second grid, and a third potential difference occurs between said second grid and said first grid.

92. The apparatus of claim 1, comprised of said electrode forming a plurality of lengths positioned within different corresponding ones of said pockets, spaced-apart from said second grids.

93. The apparatus of claim 90, comprised of said electrode forming an array comprising a plurality of spaced-apart lengths, with at least one of each of said lengths positioned within each of said pockets.

94. The process of claim 25, comprised of arranging said first electrode in an array of a plurality of spaced-apart lengths, with at least one of each of said lengths positioned within each of said pockets.

95. The apparatus of claim 31, further comprised of:

said layer extending along each of said arms in a linear continuum lying between said first grid and said second grid; and an electrical insulator maintaining said first grid physically spaced-apart from said medium.

96. The apparatus of claim 31, further comprised of an electrical insulator maintaining said first grid spaced apart from said upstream surface.

97. An electrically enhanced filtering apparatus, comprising:

a layer of a porous filter medium folded into arms forming one or more pockets with a terminus of said pocket located on a downstream side of said medium and with a base of said pocket open to an upstream side of said apparatus, with said layer disposed in a plurality of undulating pleats within each of said arms;

a first electrically conducting grid disposed at a local reference potential across a first major exterior of said medium to cover said downstream side of each of said arms;

an electrode separated from an upstream side of said medium, with said electrode spaced-apart from opposite corresponding ones of said arms while extending through said pocket;

a second electrically conducting grid electrically separated from said first grid by said medium, disposed across a second major exterior of each of said arms on an upstream side of said medium; and an electrically conducting screen disposed upstream of said electrode at said local reference potential and positioned to extend across an inlet to said apparatus and establish a first potential difference relative to said electrode, while a second potential difference occurs between said electrode and said second grid, and a third potential difference occurs between said second grid and said first grid.

98. The apparatus of claim 97, comprised of said electrode forming an array comprising a plurality of spaced-apart lengths, with at least one of each said lengths positioned within each of said pockets.

99. A filter for an electrically enhanced filtering apparatus, comprising:

a layer of a porous filter medium folded into one or more arms to fit transversely across a passageway extending between upstream and downstream ports of the apparatus, with successive pairs of said arms alternately joined together to form a terminus and spaced-apart to form a pocket providing a base open to passage of effluent between the upstream and downstream ports;

a first grid of an electrically conducting material conforming in shape to said medium to extend across each of said arms of said first major exterior surface; and a second, electrically conducting grid electrically disposed to extend in conforming shape across each of said arms of a second major exterior surface of said medium and remain in electrical separation from other electrical conductors operatively associated with said apparatus.

100. The apparatus of claim 99, further comprising at least one of said first grid and said second grid being made of a material selected from a group comprised of carbon, carbon fibers, fibers coated with carbon, and combinations thereof.

101. The filter of claim 99, comprised of said second grid being printed upon said second major surface of said medium, with an electrically conductive material selected from a group comprising carbon, carbon fibers, fibers coated with carbon, and combinations thereof.

102. The filter of claim 99, comprised of:

a frame encasing said medium, said first grid and said second grid;

said frame establishing an electrical resistance between said second grid and a local reference potential.

103. The filter of claim 99, comprised of:

a frame encasing said medium and said first grid; and a potting substance forming a seal hindering passage of the effluent between a perimeter of said medium and said frame.

104. The filter of claim 99, comprised of:

a frame encasing said medium and said first grid;

a potting substance forming a seal between a perimeter of said medium and said frame; and said frame removably receiving said second grid to lie within said folds and along said arms of said second major exterior surface of said medium.

105. The filter of claim 99, comprised of:

a frame encasing said second grid in electrical isolation from said frame;

a mat forming a seal hindering passage of the effluent between a perimeter of said filter medium and interior surfaces of said frame.

106. The filter of claim 99, comprised of:

a frame encasing said second grid;

a mat forming a seal between a perimeter of said filter medium and interior surfaces of said frame; and said frame removably receiving said medium and said first grid, with said second grid lying within said continued folds, across apices and along said arms of said second major exterior surface of said medium.

107. The process of claim 25, comprised of:

extending said medium as a layer along each of said arms in an elongate linear continuum positioned between said first grid and said second grid;

electrically isolating said second grid from direct electrical continuity with said medium;

extending an electrically conducting screen across an inlet to said apparatus;

establishing a first potential difference between said screen and said electrode with a second potential difference occurring between said electrode and said second grid, and a third potential difference occurring between said second grid and said first grid.

108. A filter for an electrically enhanced filtering apparatus, comprising:

a frame providing an inlet and an outlet;

an electrical conductor comprising a first electrically conducting porous grid attached to said frame to extend across said inlet, with said first grid folded into one or more arms forming a pocket with a terminus of said pocket positioned within said outlet and with a base of said pocket positioned to open toward said inlet; and a replaceable media assembly removably insertably within said inlet, comprised of:

a layer of a porous filter material folded into a geometric construct providing a downstream surface conforming in contour to said porous grid, receivable within said pocket to cover said arms of said first grid; and a second electrically conducting porous grid positioned in mating disposition with an upstream surface of said filter material in conformance with said contour to lie spaced-apart from other electrical conductors operatively associated with the apparatus.

109. The filter of claim 108, comprised of:

said frame electrically coupling said first grid to a local reference potential; and said layer of filter material bearing said second grid in electrical separation from said frame.

110. The filter of claim 108, comprised of:

said frame electrically coupling said first grid to a local reference potential; and said frame establishing an electrical resistance between said second grid and said local reference potential.

111. The filter of claim 108, comprised of said second grid being printed with an electrically conducting material upon said upstream surface of said medium, said electrically conducting material being selected from the group comprising carbon, carbon fibers, fibers coated with carbon, and combinations thereof.

112. The filter of claim 108, comprised of an electrical insulator interposed between said upstream surface and said first grid to maintain said first grid spaced apart from said upstream surface.

113. The filter of claim 108, comprised of:

said layer of filter material being repetitively lapped into a plurality of pleats along each of said arms, with crests of said pleats forming said upstream surface and said downstream surface; and said second grid providing said mating disposition by extending across said crests along said upstream surface.

114. A filter for an electrically enhanced filtering apparatus, comprising:

a frame providing an inlet and an outlet;

a first electrically conducting porous grid attached to said frame to extend across said inlet, with said first grid folded into one or more arms forming a pocket with a terminus of said pocket positioned within said outlet and with a base of said pocket positioned to open toward said inlet;

a replaceable layer of a porous filter material folded into a geometric construct providing an upstream surface exposed through said inlet and a downstream surface conforming in contour to said porous grid, removably receivable within said pocket to cover said arms; and a second electrically conducting porous grid removably insertable through said inlet and folded to conform to said contour of said upstream surface of said layer of filter material and cover said upstream surface of said filter material while remaining spaced-apart from electrical conductors operatively associated with the apparatus.

115. The filter of claim 114, comprised of:

said frame electrically coupling said first grid to a local reference potential; and said frame being electrically separated from said second grid.

116. The filter of claim 114, comprised of:

said frame electrically coupling said first grid to a local reference potential; and said frame establishing an electrical resistance between said second grid and said local reference potential.

117. The filter of claim 114, comprised of an electrical insulator interposed between said upstream surface and said first grid to maintain said first grid spaced apart from said upstream surface.

118. The filter of claim 114, comprised of:

said layer of filter material being repetitively lapped into a plurality of pleats along each of said arms, with crests of said pleats forming said upstream surface and said downstream surface; and said second grid covering said upstream surface by extending across said crests along said upstream surface.

119. A filter for an electrically enhanced filtering apparatus, comprising:

a replaceable media assembly, comprised of:

a layer of a porous filter material folded into one or more arms forming at least one pocket with a terminus positionable toward a downstream side of the apparatus and a base of said pocket open toward an upstream side of the apparatus;

a first electrically conducting porous grid disposed across said arms of said layer on a downstream surface of filter material;

a frame accommodating removable insertion of said media assembly, with said first grid extending across a outlet of said frame; and a second electrically conducting grid formed into a geometric construct conforming in contour to an upstream surface of said filter medium to cover said arms within said pocket while spaced-apart from electrical conductors operatively associated with the apparatus.

120. The filter of claim 119, comprised of:

said frame electrically coupling said first grid to a local reference potential; and said layer of filter material bearing said second grid in electrical separation from said frame.

121. The filter of claim 119, comprised of:

said frame electrically coupling said first grid to a local reference potential; and said frame establishing an electrical resistance between said second grid and said local reference potential.

122. The filter of claim 119, comprised of said first grid being printed with an electrically conducting material upon said downstream surface of said medium, said electrically conducting material being selected from the group comprising carbon, carbon fibers, fibers coated with carbon, and combinations thereof.

123. The filter of claim 119, comprised of an electrical insulator interposed between said upstream side and said second grid to maintain said second grid spaced apart from said upstream surface.

124. The filter of claim 119, comprised of:

said layer of filter material being repetitively lapped into a plurality of pleats along each of said arms, with crests of said pleats forming said upstream surface and said downstream surface; and said first grid being disposed across said arms of said layer by extending across said crests.

125. A filter for an electrically enhanced filtering apparatus, comprising:

a layer of a porous filter medium disposed to form a fan-fold presenting a plurality of pockets open to an upstream side of the apparatus;

a first electrically conducting grid conforming in shape to said pockets on a downstream side of said fan-fold and forming an electrical connection with a common electrical conductor of the apparatus; and a second electrically conducting grid conforming in shape to said pockets on an upstream side of said fan-fold, while remaining spaced-apart from other electrical conductors of the apparatus.

126. A process of making a filter for an electrically enhanced filtering apparatus, comprising:

disposing a layer of a porous filter medium to form a fan-fold presenting a plurality of pockets open to an upstream side of the apparatus;

disposing a first electrically conducting grid conforming in shape to said pockets on a downstream side of said fan-fold to form an electrical connection with a common electrical conductor of the apparatus; and disposing a second electrically conducting grid conforming in shape to said pockets on an upstream side of said fan-fold, to remain spaced-apart from other electrical conductors of the apparatus.

* * * * *